US008152535B2

(12) United States Patent
Ihara

(10) Patent No.: US 8,152,535 B2
(45) Date of Patent: Apr. 10, 2012

(54) SOCKET HAVING TWO RELAY BOARDS AND A FRAME FOR HOLDING A TERMINAL TO CONNECT AN ELECTRONIC DEVICE TO A MOUNTING BOARD

(75) Inventor: Yoshihiro Ihara, Nagano (JP)

(73) Assignee: Shinko Electric Industries Co., Ltd., Nagano (JP)

( * ) Notice: Subject to any disclaimer, the term of this patent is extended or adjusted under 35 U.S.C. 154(b) by 0 days.

(21) Appl. No.: 13/084,664

(22) Filed: Apr. 12, 2011

(65) Prior Publication Data

US 2011/0300746 A1 Dec. 8, 2011

(30) Foreign Application Priority Data

Jun. 8, 2010 (JP) ..... 2010-130726

(51) Int. Cl.
*H01R 12/00* (2006.01)

(52) U.S. Cl. ..... 439/66

(58) Field of Classification Search ..... 439/65, 439/66, 70, 71, 81, 91
See application file for complete search history.

(56) References Cited

U.S. PATENT DOCUMENTS

| | | | | |
|---|---|---|---|---|
| 5,139,427 | A * | 8/1992 | Boyd et al. | 439/66 |
| 6,274,823 | B1 * | 8/2001 | Khandros et al. | 174/261 |
| 6,328,573 | B1 * | 12/2001 | Sakata et al. | 439/66 |
| 7,264,486 | B2 | 9/2007 | Ma | |
| 7,621,761 | B2 * | 11/2009 | Mok et al. | 439/81 |
| 7,972,149 | B2 * | 7/2011 | Ihara | 439/81 |
| 8,083,529 | B2 * | 12/2011 | Ihara | 439/76.1 |
| 2007/0155196 | A1 | 7/2007 | Cheng et al. | |

FOREIGN PATENT DOCUMENTS

| | | |
|---|---|---|
| JP | 3114999 | 9/2000 |
| WO | WO 96/17378 | 6/1996 |

* cited by examiner

*Primary Examiner* — Chandrika Prasad
(74) *Attorney, Agent, or Firm* — IPUSA, PLLC

(57) ABSTRACT

A socket includes a first relay board provided above a mounting board; a second relay board detachably provided above the first relay board; and a frame part provided at side parts of the first relay board and the second relay board, wherein the frame part is configured to hold the first relay board and the second relay board and detachably configured to hold an electronic device being mounted above the second relay board; and the first connecting part comes in contact with the first relay board and the second connecting part comes in contact with a pad of the electronic device, so that the electronic device and the mounting board are electrically connected to each other.

13 Claims, 21 Drawing Sheets

RELATED
ART

SOCKET HAVING TWO RELAY BOARDS AND A FRAME FOR HOLDING A TERMINAL TO CONNECT AN ELECTRONIC DEVICE TO A MOUNTING BOARD

CROSS-REFERENCE TO RELATED APPLICATIONS

This patent application is based upon and claims the benefit of priority of Japanese Patent Application No. 2010-130726 filed on Jun. 8, 2010, the entire contents of which are incorporated herein by reference.

BACKGROUND OF THE INVENTION

1. Field of the Invention

The present invention generally relates to sockets. More specifically, the present invention relates to a socket configured to electrically connect an electronic device such as a semiconductor package to a mounting board or the like.

2. Description of the Related Art

Conventionally, a socket configured to electrically connect an electronic device to a mounting board or the like has been known. FIG. 1 is a first cross-sectional view showing an example of a related art socket. As shown in FIG. 1, a related art socket 200 includes a resin molded housing 201 and conductive connecting terminals 202 having spring effects.

Plural through holes 201*x* are provided in the housing 201 with designated pitches. The connecting terminal 202 includes connecting parts 215 and 216 and a spring part 217 formed in a body. The connecting terminal 202 is fixed in the through hole 201*x* of the housing 201. The connecting part 215 projects from an upper surface of the housing 201. The connecting part 216 projects from a lower surface of the housing 201.

The connecting part 216 is electrically connected to the mounting board 209 such as a motherboard via a solder ball 208. When an electronic device 205 having a pad 206 (for example, a wiring board, a semiconductor package, or the like) is pressed in a housing 201 direction, the connecting part 215 comes in contact with the pad 206. As a result of this, the connecting terminal 202 and the electronic device 205 are electrically connected to each other. In other words, the electronic device 205 is electrically connected to the mounting board 209 such as the motherboard via the connecting terminal 202. See, for example, U.S. Pat. No. 7,264,486 and United States Patent Application Publication No. 2007/0155196.

FIG. 2 is a second cross-sectional view showing another example of the related art sockets. As shown in FIG. 2, a related art socket 300 includes a gap converting board 301, a relay board 304, and bolts 309.

Plural connecting terminals 302 having spring effects are fixed on one of surfaces of the gap converting board 301. Plural pads 303 are provided on another surface of the gap converting board 301. Plural connecting terminals 305 having spring effects are fixed on one of surfaces of the relay board 304. Plural connecting terminals 306 having spring effects are fixed on another surface of the relay board 304. The connecting terminals 305 and the connecting terminals 306 are electrically connected to each other. Plural pads 308 are provided on another surface of the mounting board 307.

When the gap converting board 301, the relay board 304, and the mounting board 307 are fixed to each other by the bolts 309, each of the pads 303 of the gap converting board 301 comes in contact with the corresponding connecting terminal 305 of the relay board 304 and each of the pads 308 of the relay board 307 comes in contact with the corresponding connecting terminal 306 of the relay board 304. As a result of this, the pads 303 of the gap converting board 301 and the corresponding pads 308 of the relay board 307 are electrically connected to each other via the relay board 304. In addition, by connecting the connecting terminals 302 of the gap converting board 301 to the corresponding pads 311 of the semiconductor chip 310 with solder or the like, the semiconductor chip 310 which is an electronic device is electrically connected to the mounting board 307 such as the motherboard via the gap converting board 301 and the relay board 304. See, for example, Japanese Patent No. 3,114,999.

In the meantime, in the socket 200 shown in FIG. 1, when the housing 201 is formed by molding resin, heat is applied so that a warpage may be generated. In addition, when the connecting terminals 202 and the mounting board 209 such as the motherboard are connected to each other via the solder balls 208, heat at, for example, approximately 230° C. is applied so that the solder balls 208 are melted. At this time, since the housing 201 made by molding the resin has substantially the same temperature, the warpage of the housing 201 may be generated.

In the socket 200, the warpage of the housing 201 may become large when the neighboring connecting terminals 202 (neighboring through holes 201*x*) are arranged with narrow pitches or the housing 201 is made thin. The warpage of the housing 201 may be a reason why the connecting reliability between the connecting terminal 202 and the mounting board 209 such as the motherboard becomes degraded.

Furthermore, in the socket 300 shown in FIG. 2, since the connecting terminals 305 and 306 are fixed to corresponding surfaces of the relay board 304, an interval from a head end part of the connecting terminal 305 to a head end part of the connecting terminal 306 via the relay board 304 is long. Because of this, a connecting path (a transmission path of a signal) between the semiconductor chip 310 which is the electronic device and the mounting board 307 such as the motherboard is long and thereby electric capabilities may be influenced.

SUMMARY OF THE INVENTION

Accordingly, embodiments of the present invention may provide a novel and useful socket solving one or more of the problems discussed above.

More specifically, the embodiments of the present invention may provide a socket whereby generation of a warpage is prevented, connection reliability between a connecting terminal and a mounting board or the like is improved, and a connecting path between an electronic device and the mounting board or the like can be shortened.

Another aspect of the embodiments of the present invention may be to provide a socket, including a first relay board provided above a mounting board; a second relay board detachably provided above the first relay board; and a frame part provided at side parts of the first relay board and the second relay board, wherein the frame part is configured to hold the first relay board and the second relay board and detachably configured to hold an electronic device being mounted above the second relay board; the second relay board includes a board main body having a through hole, and a connecting terminal fixed to the board main body in a state where the connecting terminal is inserted through the through hole, the connecting terminal including a first connecting part configured to project from the board main body to the first relay board side and a second connecting part configured to project from the board main body to the electronic device side, and the first connecting part comes in contact with the first relay board and the second connecting part comes in contact with a pad of the electronic device, so that the electronic device and the mounting board are electrically connected to each other.

According to the embodiments of the present invention, it is possible to provide a socket whereby the generation of the warpage is prevented, the connecting reliability between the connecting terminal and the mounting board or the like is improved, and the connecting path between the electronic device and the mounting board or the like can be shortened.

Additional objects and advantages of the embodiments are set forth in part in the description which follows, and in part will become obvious from the description, or may be learned by practice of the invention. The object and advantages of the invention will be realized and attained by means of the elements and combinations particularly pointed out in the appended claims. It is to be understood that both the foregoing general description and the following detailed description are exemplary and explanatory and are not restrictive of the invention as claimed.

DETAILED DESCRIPTION OF THE PREFERRED EMBODIMENTS

Figure 1:
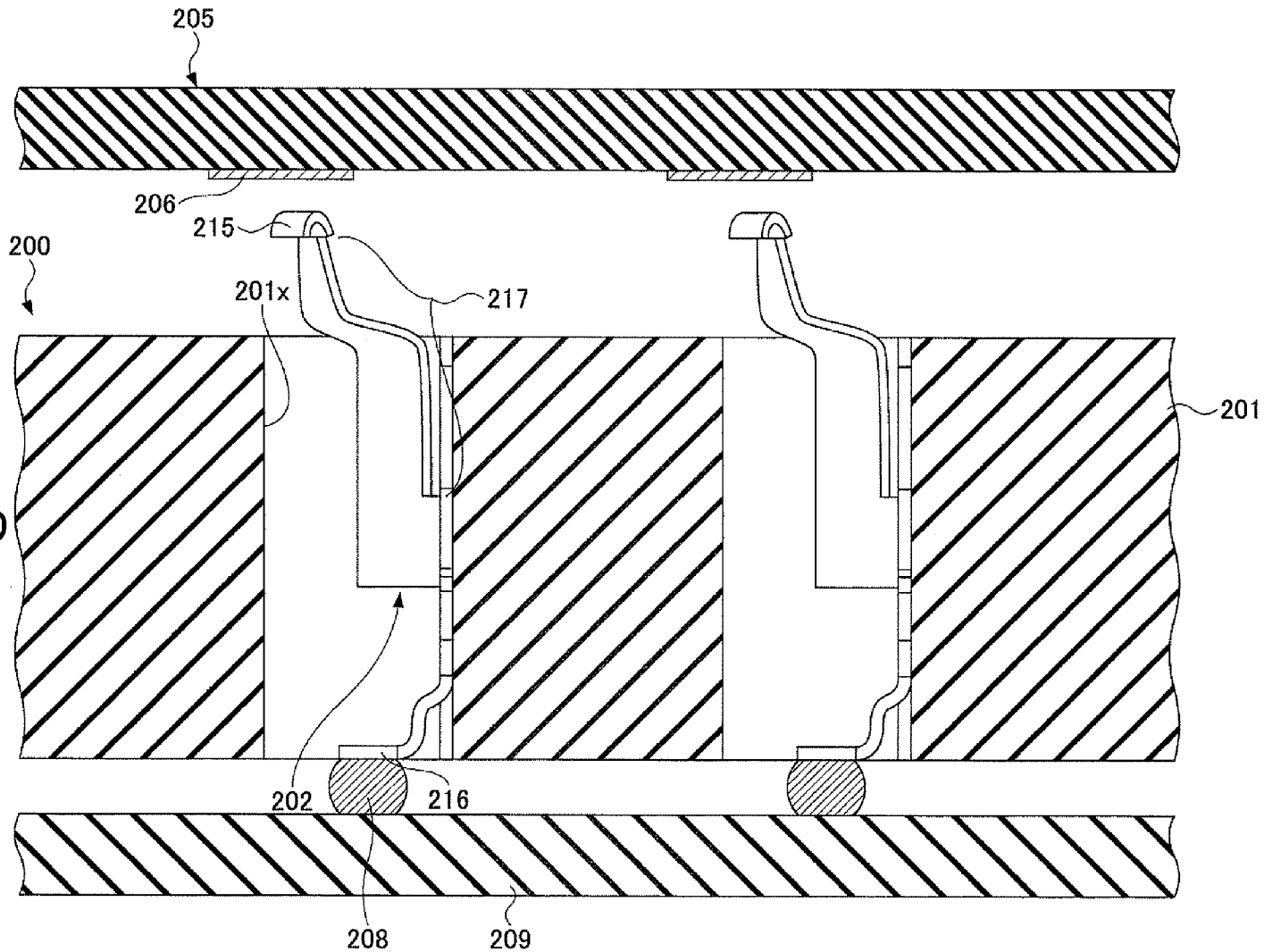
FIG. 1 is a first cross-sectional view showing an example of a related art socket.

A description is given below, with reference to the FIG. 3 through FIG. 16 of embodiments of the present invention. In each of drawings, parts that are the same as the parts shown in another drawing are given the same reference numerals, and explanation thereof may be omitted.

In the embodiments and modified examples thereof, as an example, a case where a semiconductor package, a first relay board, and a second relay board have rectangular shaped planar configurations is discussed. However, the planar configurations of the semiconductor package, the first relay board, and the second relay board are not limited to the rectangular shaped configurations but may be optional.

(First Embodiment)

Figure 3:
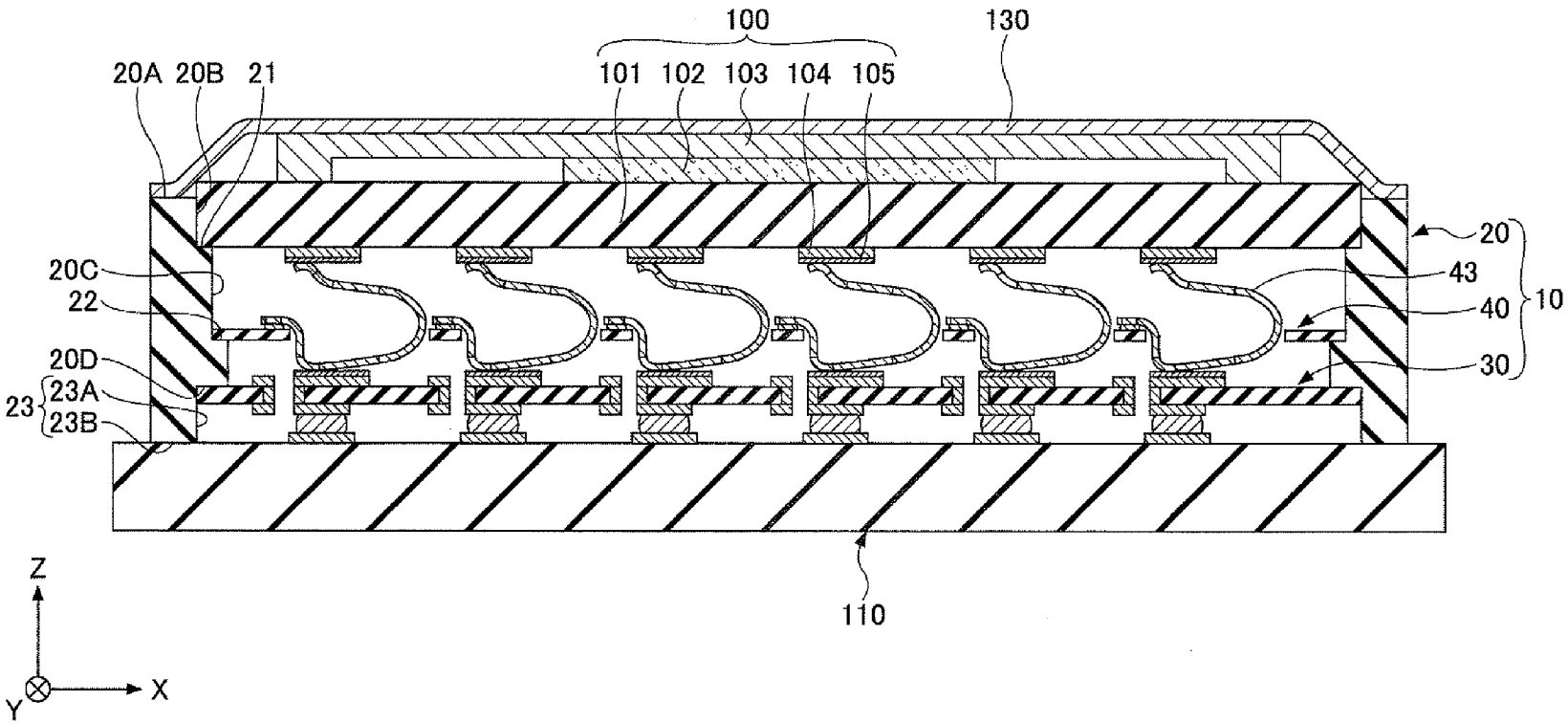
FIG. 3 is a cross-sectional view showing an example of a socket of a first embodiment of the present invention.
Figure 4:
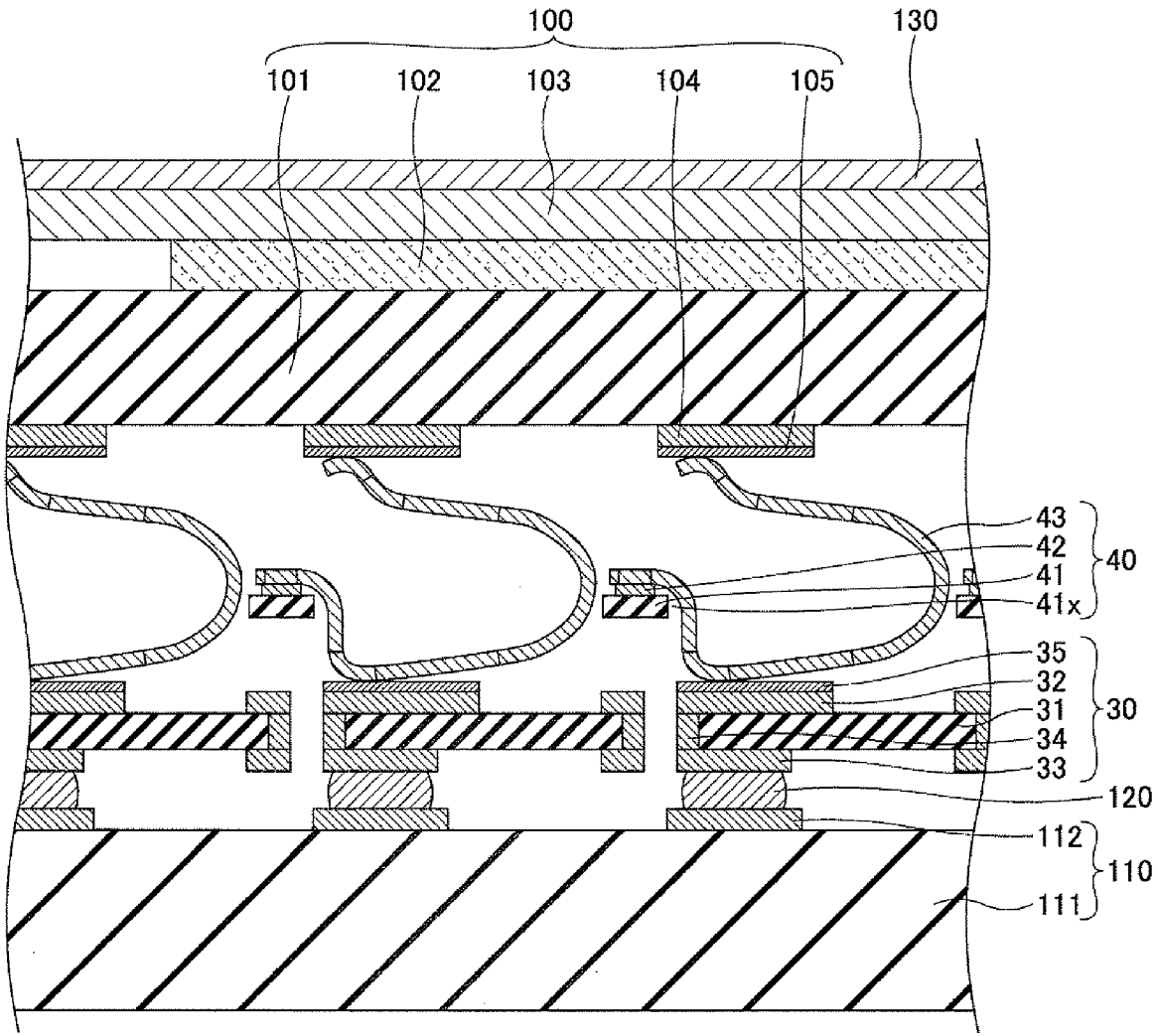
FIG. 4 is a cross-sectional view where a part of a structure shown in FIG. 3 is shown in an expanded manner.

FIG. 3 is a cross-sectional view showing an example of a socket of a first embodiment of the present invention. FIG. 4 is a cross-sectional view where a part of a structure shown in FIG. 3 is shown in an expanded manner. As shown in FIG. 3 and FIG. 4, the socket 10 includes a frame part 20, a first relay board 30, and a second relay board 40. In FIG. 3 and FIG. 4, the numerical reference 100 denotes a semiconductor package which is an example of an electronic device. The numerical reference 110 denotes a mounting board such as a motherboard. The numerical reference 130 denotes a lid part. The semiconductor package 100 is electrically connected to the mounting board 110 via the socket 10. In the first embodiment, the semiconductor package 100 is discussed as an example of the electronic device. However, the electronic device is not limited to the semiconductor package 100 but may be a wiring board or the like not having a semiconductor chip or a semiconductor device.

Next, details of the socket 10, the semiconductor package 100, and the mounting board 110 are discussed with reference to FIG. 3, FIG. 4, and FIG. 5A through FIG. 5C.

Figure 5A:
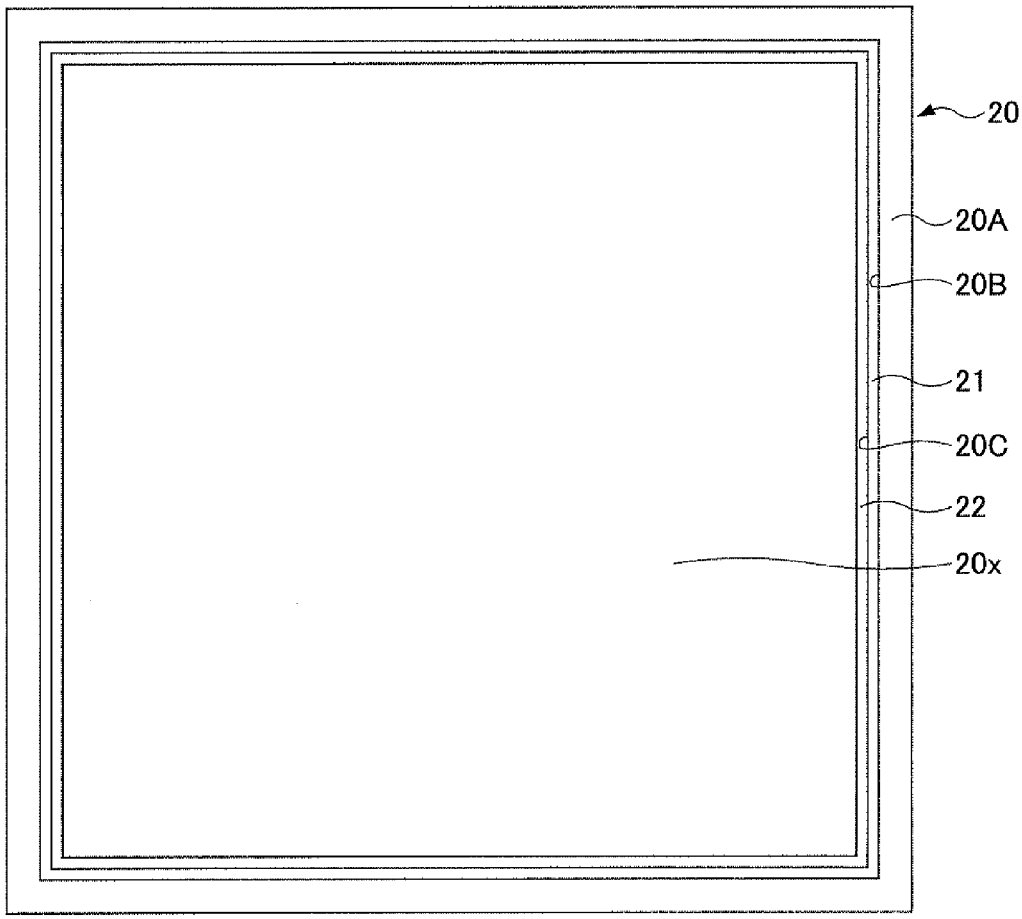
FIG. 5A is a plan view showing an example of a frame part of the socket of the first embodiment of the present invention.
Figure 5B:
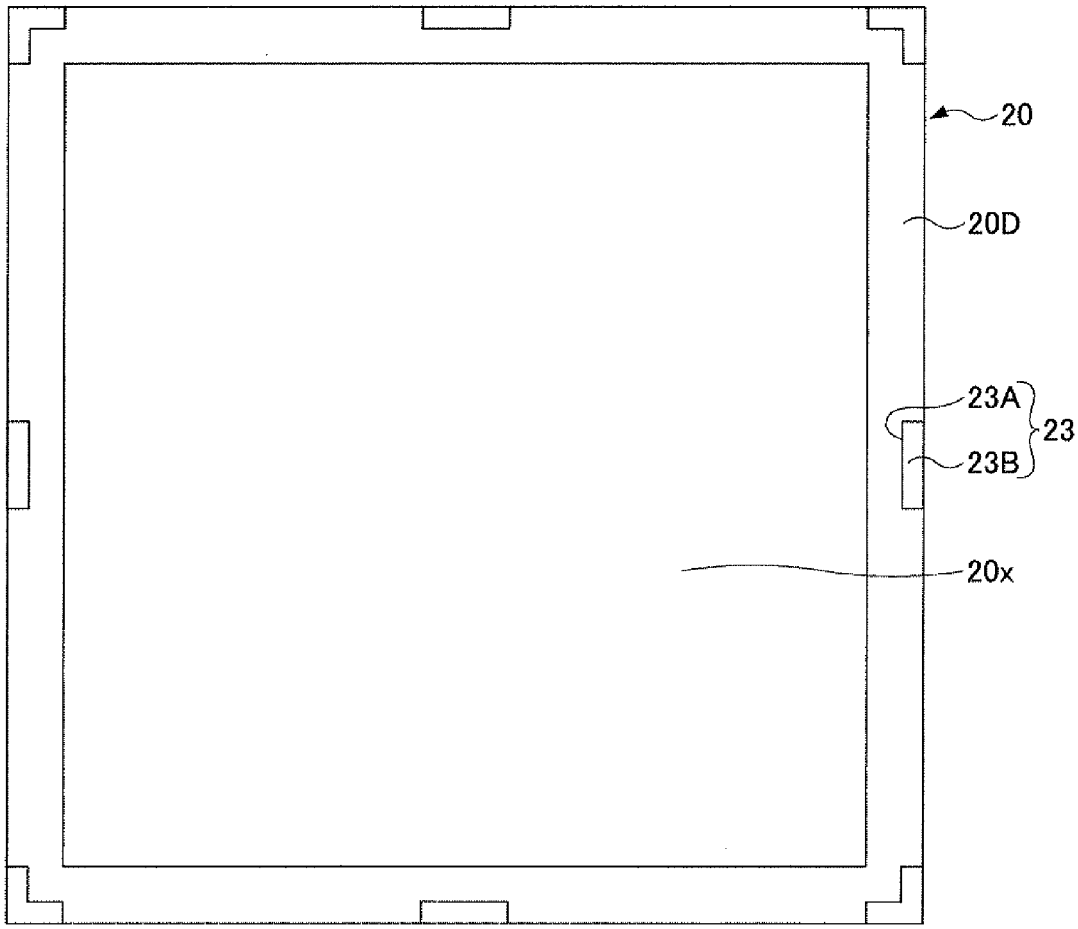
FIG. 5B is a bottom view showing the example of the frame part of the socket of the first embodiment of the present invention.
Figure 5C:
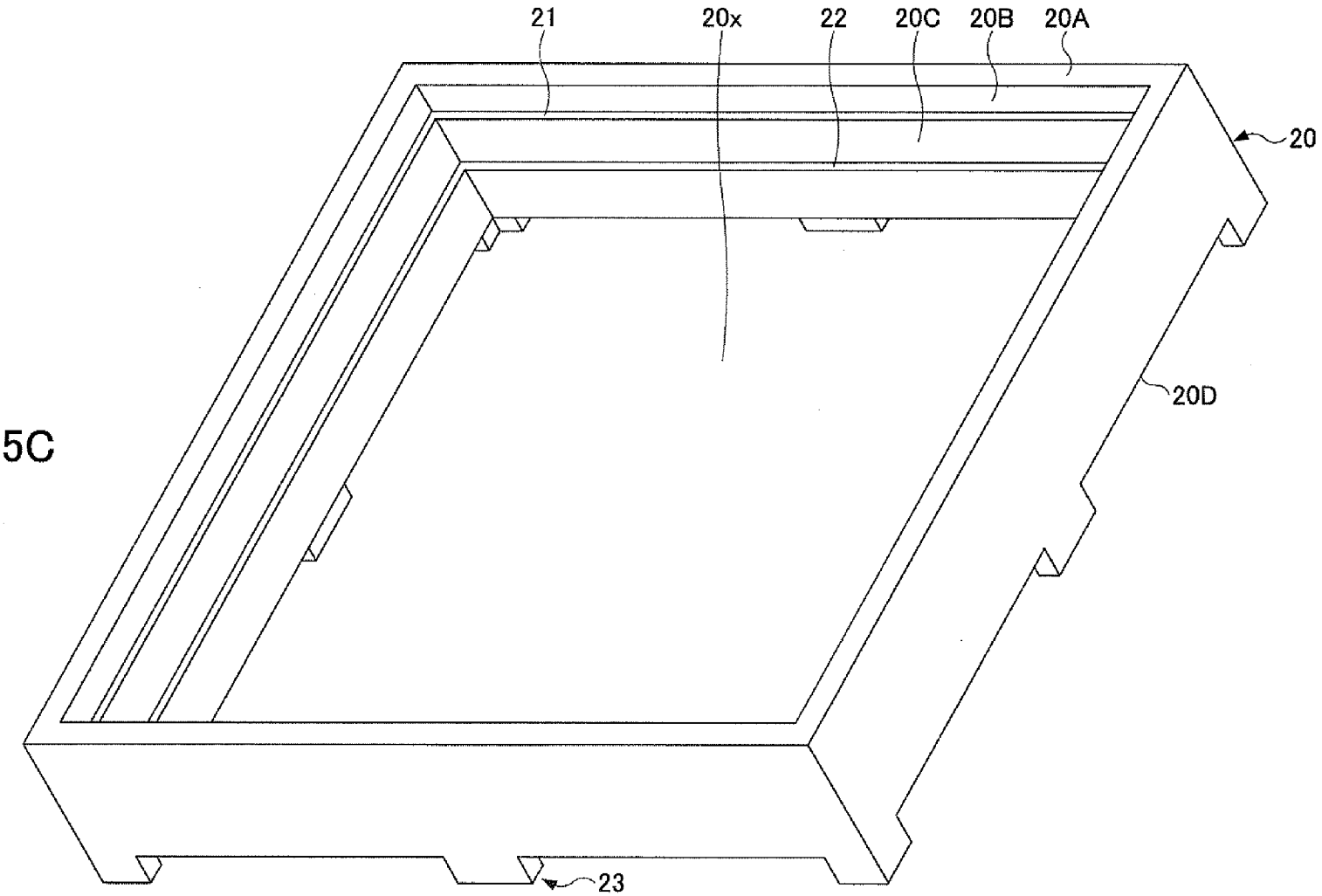
FIG. 5C is a perspective view showing the example of the frame part of the socket of the first embodiment of the present invention.

FIG. 5A through FIG. 5C show an example of the frame part 20 of the socket 10 of the first embodiment. FIG. 5A is a plan view, FIG. 5B is a bottom view, and FIG. 5C is a perspective view. As shown in FIG. 5A through FIG. 5C, in the frame part 20, a first positioning and holding part 21, a second positioning and holding part 22, and a third positioning and holding part 23 are provided a frame shaped member having a rectangular-shaped opening part 20*x* situated in the center. The frame part 20 is made of resin, metal, or the like. The frame part 20 is configured to position and hold the first relay board 30, the second relay board 40, and the semiconductor package 100 so that the first relay board 30, the second relay board 40, and the semiconductor package 100 are aligned. In addition, the frame part 20 is configured to prevent a gap between the first relay board 30 and the second relay board 40 and a gap between the second relay board 40 and the semiconductor package 100 from being equal to or less than a designated value.

The first positioning and holding part 21 is a surface provided in a frame-shaped manner in a position one step below and inside an upper surface 20A of the frame part 20. The first positioning and holding part 21 comes in contact with an external edge part of a lower surface of a board 101 of the semiconductor package 100. An opening part forming an internal side surface 20B has a rectangular shaped configuration corresponding to a planar shaped configuration of the semiconductor package 100. In addition, the configuration of the opening part forming the internal side surface 20B is slightly larger than an external configuration of the board 101 so that the semiconductor package 100 can be attached or detached. The internal side surface 20B and a side surface of the board 101 may come in contact with each other. A gap may be provided between the internal side surface 20B and a side surface of the board 101 as long as a positional shift is not generated between the second relay board 40 and the semiconductor package 100.

The second positioning and holding part 22 is a surface provided in a frame-shaped manner in a position one step below and inside the first positioning and holding part 21. The second positioning and holding part 22 comes in contact with an external edge part of a lower surface of the second relay board 40. An opening part forming an internal side surface 20C has a rectangular shaped configuration corresponding to a planar shaped configuration of the second relay board 40. In addition, the configuration of the opening part forming the internal side surface 20C is slightly larger than an external configuration of the second relay board 40 so that the second relay board 40 can be attached or detached. The internal side surface 20C and a side surface of the second relay board 40 may come in contact with each other. A gap may be provided between the internal side surface 20C and a side surface of the second relay board 40 as long as a positional shift is not generated between the second relay board 40 and the first relay board 30.

Plural of the third positioning and holding parts 23 are provided at external edge parts of a lower surface 20D of the frame part 20. The third positioning and holding part 23 is a projecting part projecting from the lower surface 20D. The first relay board 30 is press-fitted between the third positioning and holding parts 23 so that the lower surface 20D comes in contact with the external edge part of the upper surface of the first relay board 30 and internal side surfaces 23A of the third positioning and holding parts 23 come in contact with the side surface of the first relay board 30. An opening part formed by the internal side surfaces 23A has a rectangular shaped configuration corresponding to a planar shaped configuration of the first relay board 30. In addition, the configuration of the opening part formed by the internal side surfaces 23A is substantially the same as the external configuration of the first relay board 30 so that the first relay board 30 can be press-fitted. The height from the lower surface 20D to bottom surfaces 23B of the third positioning and holding parts 23 is substantially the same as the height from the upper surface of the mounting board 110 to the upper surface of the first relay board 30. The bottom surfaces 23B of the third positioning and holding parts 23 come in contact with the upper surface of the mounting board 110.

Although the frame part 20 is not fixed to the mounting board 110, the first relay board 30 is fixed to the mounting board 110 by solder 120. Therefore, the frame part 20 where the first relay board 30 is press-fitted is indirectly fixed to the mounting board 10.

The mounting board 110 such as the motherboard includes a board main body 111 and a conductive layer 112 which has pads of a wiring pattern. The conductive layer 112 is formed on one of surfaces of the board main body 111. The board main body 111 is made by, for example, insulation resin such as epoxy resin contain a glass cloth. The conductive layer is made of, for example, copper (Cu). In the first embodiment, gold (Au) plating for improving connecting reliability is not applied to a surface of the conductive layer 112.

The first relay board 30 of the socket 10 includes a board main body 31, conductive layers 32 and 33, a conductive layer 34, and a noble metal layer 35. The conductive layers 32, 33 and 34 and the noble metal layer 35 form a wiring pattern. The conductive layer 32 and the noble metal layer 35 are provided on one of surfaces of the board main body 31. The conductive layer 33 is provided on another surface of the board main body 31. The conductive layers 32 and 33 are electrically connected to each other through the conductive layer 34 in a through hole provided in the through hole which pierces from one of the surfaces of the board main body 31 to another surface of the board main body 31. The through hole may be filled with the conductive layer 34.

The board main body 31 is made by, for example, soaking insulation resin such as epoxy resin into a glass cloth. The thickness of the board main body 31 may be, for example, approximately 100 μm through approximately 200 μm. As materials of the conductive layers 32 and 33 and the conductive layer 34, for example, copper (Cu) can be used. The thickness of the conductive layers 32 and 33 can be, for example, approximately 5 μm through approximately 10 μm. The conductive layers 32 and 33 can be formed by various kinds of methods such as a semi-additive method or a subtractive method. The noble metal layer 35 is stacked on the upper surface of the conductive layer 32. As the noble metal layer 35, for example, a layer including noble metal such as gold (Au) or palladium (Pd) can be used. The noble metal layer 35 can be formed by, for example, an electroless plating method. As a layer provided below the gold (Au) layer, a nickel (Ni) layer, a Ni/Pd layer (a layer formed by stacking a Ni layer and a Pd layer in this order), or the like may be formed.

The noble metal layer 35 is provided so that the reliability for connecting a connecting terminal 43 is improved. The noble metal layer 35 is made drastically thicker than that of a normal gold plating layer so that the noble metal layer 35 can be crush-proof against a force from the connecting terminal 43 having a spring effect. The thickness of a gold plating layer or the like normally provided for improving the reliability for connecting a solder ball or the like may be equal to or lower than, for example, approximately 0.05 μm. On the other hand, the thickness of the noble metal layer 35 may be for example, approximately 0.4 μm which is equal to or more than eight times the thickness of the gold plating layer or the like which is normally provided.

The conductive layer 33 of the first relay board 30 and the conductive layer 112 of the mounting board 110 are electrically connected to each other via the solder 120. As a material of the solder 120, for example, an alloy including Pb, an alloy including Sn and Cu, an alloy including Sn and Ag, an alloy including Sn, Ag, and Cu, or the like can be used. Instead of the solder 120, for example, a conductive resin paste (for example, Ag paste) or the like can be used.

The second relay board 40 of the socket 10 includes a board main body 41 having a through hole 41*x*, an adhesive 42, and the connecting terminal 43 having a spring effect. The connecting terminal 43 is inserted through the through hole 41*x* and adhered to one of surfaces of the board main body 41 by the adhesive 42 so as to project from both the surfaces of the board main body 41. A configuration of the through hole 41*x* can be properly determined based on the configuration of the connecting terminal 43. The through hole 41*x* may have, for example, a rectangular shaped configuration.

The board main body 41 is a base member configured to fix the connecting terminal 43. As the board main body 41, for example, a rigid board (for example, FR4 material) may be formed by soaking insulation resin such as epoxy resin into a glass cloth. As the board main body 41, a flexible film board using insulation resin such as polyimide resin can be used. The thickness of the board main body 41 may be, for example, approximately 50 μm through approximately 100 μm.

A wiring pattern is not provided in the board main body 41. However, the wiring pattern may be, if necessary, provided in the board main body 41. For example, in a case where neighboring connecting terminals make the same connection of an electric power supply, a ground electric potential (GND), or the like, it is possible to stabilize the electric power supply, the ground electric potential (GND), or the like by commonly connecting the electric power supply, the ground electric potential (GND), or the like by the wiring pattern provided in the board main body 41.

The adhesive 42 is configured to fix the connecting terminal 43 to the board main body 41. It is preferable to use a thermosetting adhesive as the adhesive 42. This is because even if the temperature becomes high due to heat generated by the semiconductor package 100, ambient atmospheric temperature at which the socket 10 is used, or the like, it is necessary to prevent the adhesive 42 from being melted. As the board main body 41 and the adhesive 42, for example, a flexible film board where a thermosetting adhesive layer is formed on a surface of the insulation resin such as polyimide resin may be used.

The connecting terminal 43 has a spring effect. The connecting terminal 43 has electrical conductivity and is made of, for example, a Cu alloy such as phosphor copper or beryllium copper.

One end of the connecting terminal 43 detachably comes in contact with the noble metal layer 35 of the first relay board 30 and is electrically connected to the noble metal layer 35. Another end of the connecting terminal 43 detachably comes in contact with a noble metal layer 105, discussed below, of the semiconductor package 100 and is electrically connected to the noble metal layer 105. In other words, the frame part 20 positions and holds the first relay board 30, the second relay board 40, and the semiconductor package 100, so that one end of the connecting terminal 43 is situated in a position corresponding to the noble metal layer 35 of the first relay board 30 and another end of the connecting terminal 43 is situated in a position corresponding to the noble metal layer 105 of the semiconductor package 100. Details of a structure of the connecting terminal 43 are discussed below.

The semiconductor package 100 which is an electronic device includes the board 101, a semiconductor chip 102, a heat radiating plate 103, a conductive layer 104, and the noble metal layer 105. The board 101 has a structure where an insulation layer, a wiring pattern, conductive layer (not illustrated), and others are formed on a board main body including, for example, insulation resin.

The semiconductor chip 102 including silicon or the like is mounted on one of surfaces of the board 101. The conductive layer 104 which is a part of the wiring pattern is formed on another surface of the board 101. A material of the conductive layer 104 is, for example, copper (Cu). A thickness of the conductive layer 104 is, for example, approximately 5 μm through approximately 10 μm. The heat radiating plate 103 made of, for example, copper (Cu) is provided on the semiconductor chip 102. In a case where the amount of heat radiating from the semiconductor chip 102 is small, it may not be necessary to provide the heat radiating plate 103.

The noble metal layer 105 is stacked on the outer surface of the conductive layer 104. Since a material or a thickness of the noble metal layer 105 is the same as that of the noble metal layer 35, explanation thereof is omitted. The conductive layer 104 and the noble metal layer 105 have pads arranged, for example, in a grid manner on another surface of the board 101. In other words, the semiconductor package 100 has a so-called LGA (Land Grid Array) structure and the socket 10 is used for the LGA semiconductor package.

The lid part 130 is arranged on the semiconductor package 100. The lid part 130 is, for example, a substantially rectangular-shaped or substantially frame shaped member made of metal. The lid part 130 is, for example, rotatably arranged at one end side of the upper surface 20A of the frame part 20. A lock mechanism is provided at another end side of the upper surface 20A of the frame part 20. As shown in FIG. 3, by fixing (locking) the external edge part of the lid part 130 so that the external edge part of the lid part 130 comes in contact with the upper surface 20A of the frame part 20, the connecting terminal 43 is pressed and deformed in a Z direction so that a designated spring force is generated. As a result of this, the semiconductor package 100 is securely and electrically connected to the first relay board 30 via the connecting terminal 43 of the second relay board 40. In other words, the semiconductor package 100 which is the electronic device is electrically connected to the mounting board 110 via the socket 10. By unlocking the lid part 130, the semiconductor package 100 and the second relay board 40 can be attached to or detached from the frame part 20.

The lid part 130 may be provided separately from the frame part 20. In this case, for example, a structure may be applied where the lid part 130 can be fixed to the frame part 20 in a state where the semiconductor package 100 is pressed from an upper side by the lid part 130. In the socket 10, the connecting terminal 43 having a spring effect is directly fixed to the board main body 41 of the second relay board 40.

The housing which may cause the warpage is not provided. Therefore, in this embodiment, the socket whereby the warpage may not be generated can be realized. By preventing the generation of the warpage, it is possible to improve the reliability of connecting the semiconductor package 100 and the mounting board 110 to each other. Furthermore, since the second relay board 40 is not fixed to the neighboring first relay board 30 and the semiconductor package 100 by the solder or the like, the second relay board 40 can be attached to or detached from the frame part 20. Because of this, even if the second relay board 40 is damaged, it is possible to replace the damaged second relay board 40 with a good one.

Figure 2:
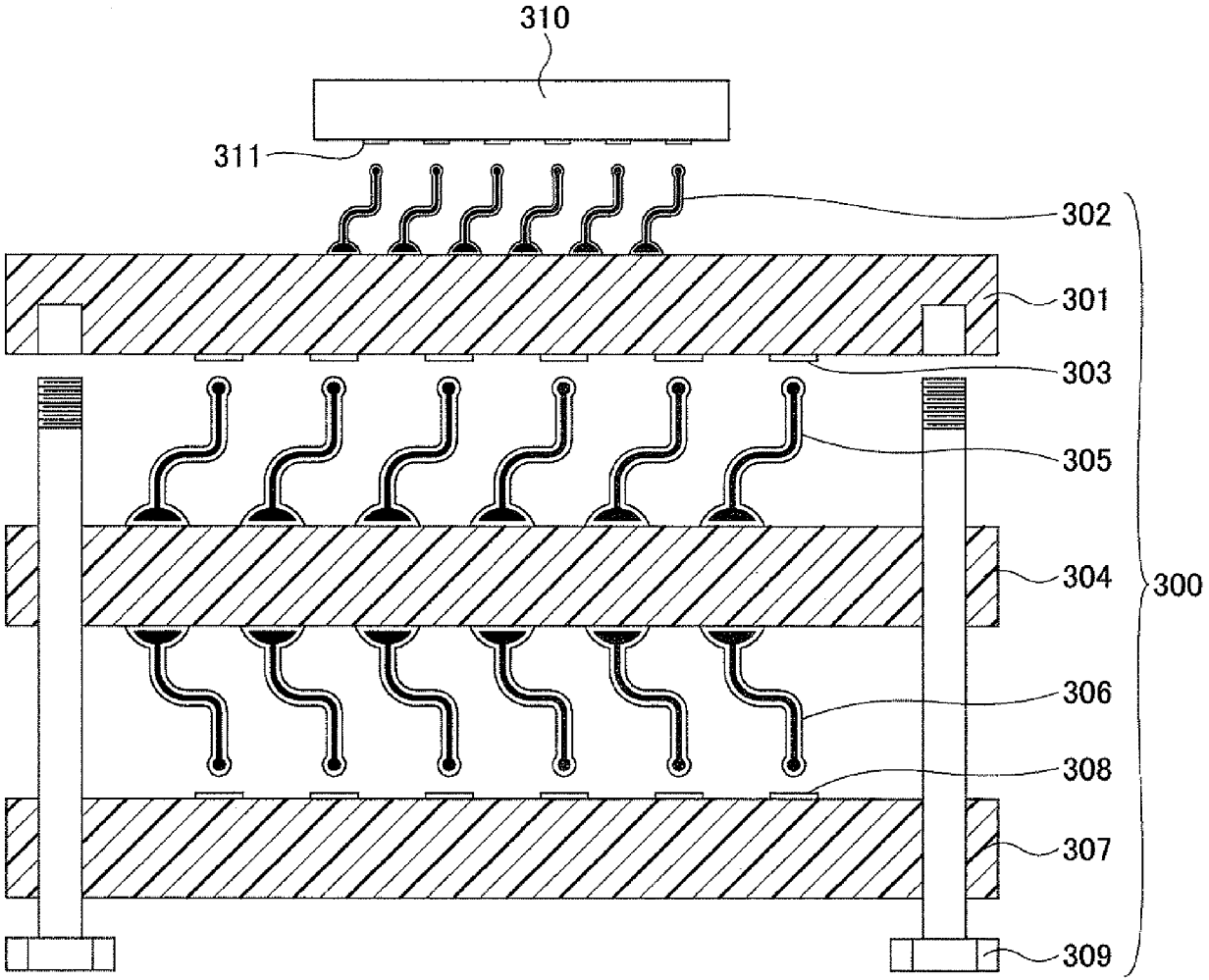
FIG.2 RELATED ART
FIG. 2 is a second cross-sectional view showing the example of the related art socket.

In the second relay board 40, unlike the related art relay board 304 (shown in FIG. 2), the connecting terminals 305 and 306 are not fixed to both surfaces. In the second relay board 40, a single connecting terminal 43 is inserted and fixed into the through hole 41*x* so as to project from both surfaces. Therefore, it is possible to shorten a length from one end to another end of the connecting terminal 43. Hence, a path between the semiconductor package 100 which is an electronic device and the mounting board 110 such as the motherboard (transferring path of the signal) can be shortened so that electric capabilities can be improved. With this structure, it is possible to reduce the height of the socket 10.

If the first relay board 30 is not provided and the connecting terminal 43 having a spring effect is made to directly contact the conductive layer 112 of the mounting board 110 such as the motherboard, the conductive layer 112 having a surface where the noble metal layer is not provided, it is not possible to achieve sufficient connecting reliability. However, in the first embodiment, the first relay board 30 is connected to the mounting board 110 such as the motherboard by the solder 120 or the like. The connecting terminal 43 having a spring effect comes in contact with the noble metal layer 35 of the first relay board 30. Therefore, it is possible to achieve high connecting reliability.

Figure 6A:
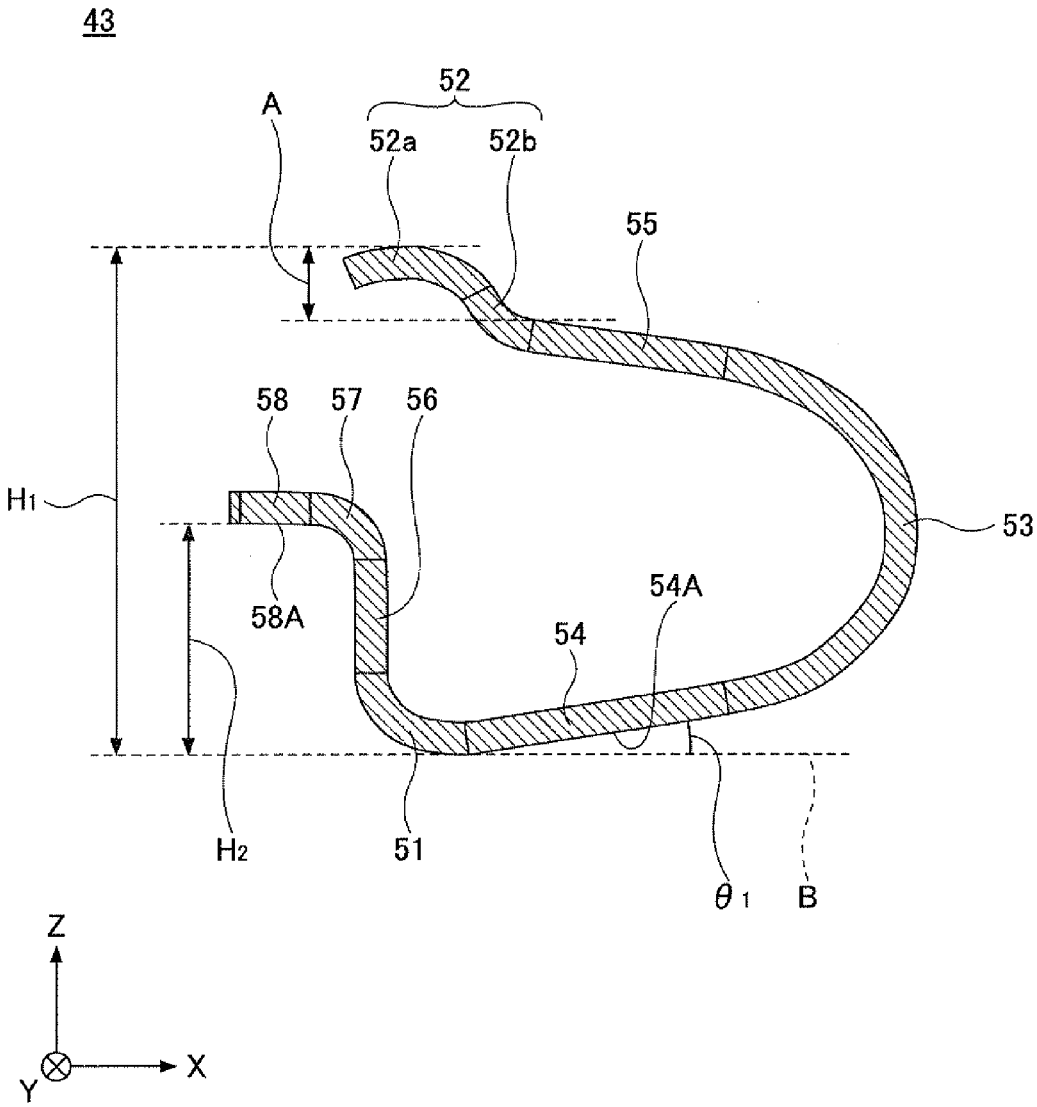
FIG. 6A is a cross-sectional view showing a connecting terminal of the first embodiment of the present invention.
Figure 6B:
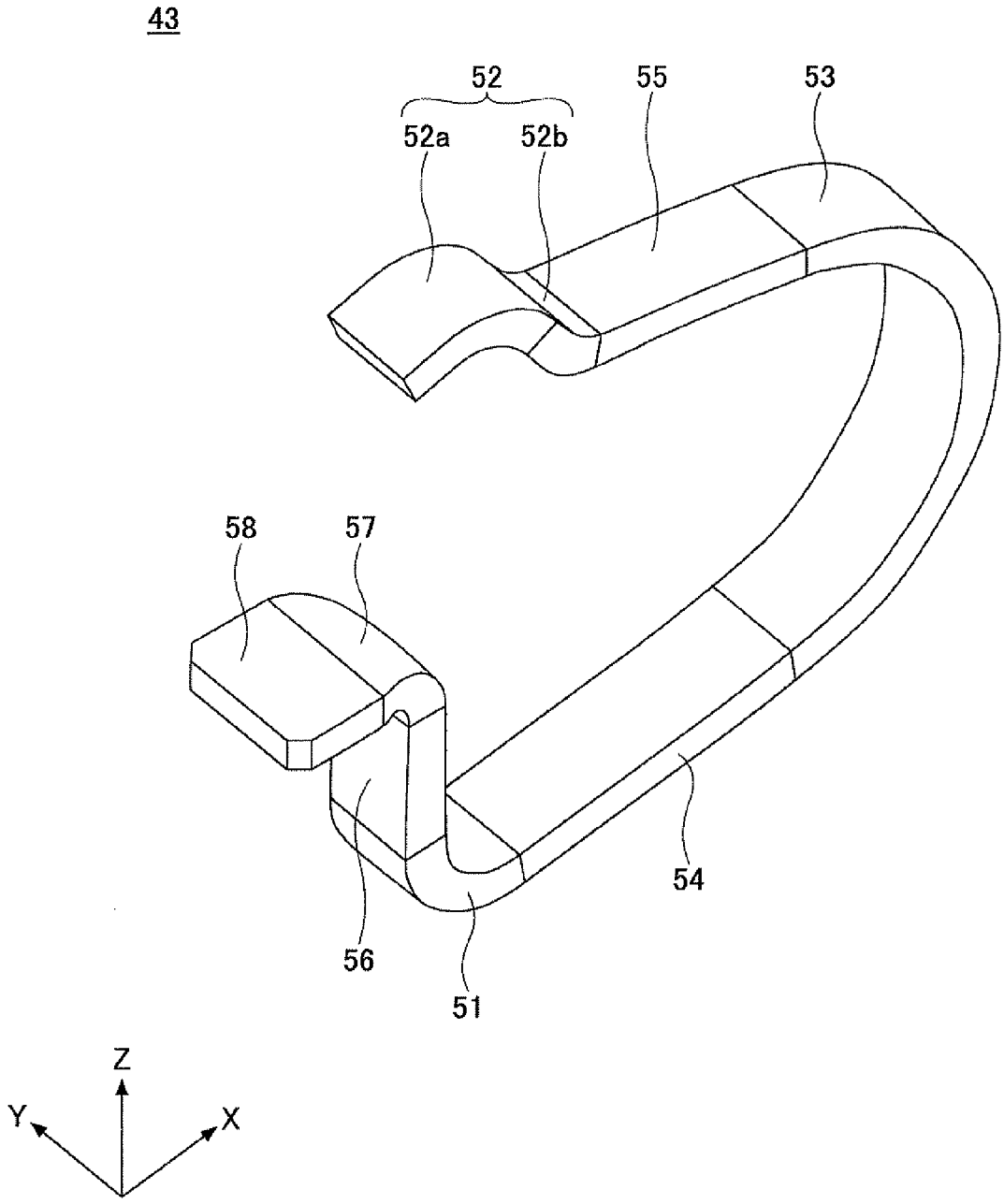
FIG. 6B is a perspective view showing the connecting terminal of the first embodiment of the present invention.

Here, details of the structure of the connecting terminal 43 are discussed with reference to FIG. 6. FIG. 6A and FIG. 6B are views showing the connecting terminal 43 of the first embodiment of the present invention. FIG. 6A is a cross-sectional view and FIG. 6B is a perspective view. As shown in FIG. 6A and FIG. 6B, the connecting terminal 43 includes a first connecting part 51, a second connecting part 52, a spring part 53, a first supporting part 54, a second supporting part 55, a third supporting part 56, a bending part 57, and an adhering part 58.

The connecting terminal 43 has a spring effect. The connecting terminal 43 has conductivity and is made of, for example, a Cu alloy such as phosphor copper or beryllium copper. A nickel (Ni) plating, a nickel (Ni) alloy plating, or the like may be applied to the surface of the connecting terminal 43.

The first connecting part 51 has an R-shaped configuration. The first connecting part 51 has a thickness of, for example, approximately 0.08 mm. The first connecting part 51 comes in contact with, for example, the noble metal layer 35 of the first relay board 30. By forming an Au plating film (having a thickness of, for example, approximately 0.3 μm through approximately 0.5 μm) or the like on the surface of the first connecting part 51 (which comes in contact with the noble metal layer 35 or the like), it is possible to decrease the contact resistance.

The second connecting part 52 is arranged above the first connecting part 51 so as to face the first connecting part 51. The second connecting part 52 is electrically connected to the first connecting part 51 via the spring part 53, the first supporting part 54, and the second supporting part 55. The second connecting part 52 includes a contact part 52*a* and a projecting part 52*b*.

The contact part 52*a* comes in contact with, for example, the noble metal layer 105 of the semiconductor package 100. By forming an Au plating film (having a thickness of, for example, approximately 0.3 μm through approximately 0.5 μm) or the like on the surface of the contact part 52 (which comes in contact with the noble metal layer 105 or the like), it is possible to decrease the contact resistance. When the connecting terminal 43 is pressed, the contact part 52*a* mainly moves in a thickness direction of the semiconductor package (Z direction of FIG. 6A). The contact part 52*a* has a round-shaped configuration. Since the contact part 52*a* has the round-shaped configuration, it is possible to prevent the noble metal layer 105 or the like from being damaged by the contact part 52*a* when the contact part 52*a* is pressed so as to come in contact with the noble metal layer 105 or the like.

In addition, the contact part 52*a* comes in contact with the noble metal layer 105 or the like in a state where the second connecting part 52 moves in a Z direction in FIG. 3 where the second connecting part 52 approaches the first connecting part 51 due to deformation of the spring part 53 when, for example, the semiconductor package 100 presses the second connecting part 52. Because of this, even if the noble metal layer 105 or the like and the second connecting part 52 come in contact with each other, the second connecting part 52 does not move a lot in a direction parallel with a surface where the noble metal layer 105 or the like is formed (X direction in FIG. 6A). Hence, it is possible to arrange the pads of the noble metal layer 105 or the like with a narrow pitch.

One end part of the projecting part 52*b* is formed in a body with the second supporting part 55. Another end part of the projecting part 52*b* is formed in a body with the contact part 52*a*. The projecting part 52*b* projects in a direction from the second supporting part 55 toward the noble metal layer 105 or the like (a direction separating from the first connecting part 51).

Thus, in this embodiment, the projecting part 52*b* is provided between the contact part 52*a* and the second supporting part 55. The projecting part 52*b* is formed in a body with the contact part 52*a* and the second supporting part 55. The projecting part 52*b* projects in a direction from the second supporting part 55 toward the noble metal layer 105 or the like (a direction separating from the first connecting part 51). With this structure, therefore, it is possible to prevent the contact of the noble metal layer 105 or the like and the projecting part 52*b* based on the deformation of the spring part 53 when the semiconductor package 100 or the like presses the second connecting part 52. Therefore, it is possible to prevent damage of the connecting terminal 43, the noble metal layer 105, and others.

A projecting amount A of the second connecting part 52 in a state where the noble metal layer 105 or the like and the second connecting part 52 do not come in contact with each other (a projecting amount from a connecting part of the second supporting part 55 and the projecting part 52*b*) may be, for example, approximately 0.3 mm. In addition, the thickness of the second connecting part 52 may be, for example, approximately 0.08 mm.

The spring part 53 is arranged between the first supporting part 54 and the second supporting part 55. The spring part 53 is formed in a body with the first supporting part 54 and the second supporting part 55. The spring part 53 has a curved configuration (such as a C-shaped configuration) and also a spring effect.

When the second connecting part 52 is pressed by the semiconductor package 100 or the like, the spring part 53 urges the second connecting part 52 to repel in a direction toward the noble metal layer 105 or the like. As a result of this, the second connecting part 52 and the noble metal layer 105 or the like are not fixed but the second connecting part 52 and the noble metal layer 105 or the like come in contact with each other.

The width and thickness of the spring part 53 can be the same as those of the second part 52. In the connecting terminal 43 of the first embodiment, the second connecting part 52, the spring part 53, the first supporting part 54 and the second supporting part 55 work in a body as a spring. A spring constant of a portion of the connecting terminal corresponding to the second connecting part 52, the spring part 53, the first supporting part 54 and the second supporting part 55 can be, for example, approximately 0.6 N/mm and approximately 0.8 N/mm.

The first supporting part 54 is provided between the spring part 53 and the first connecting part 51. One of end parts of the first supporting part 54 is formed in a body with one of end parts of the spring part 53. Another end part of the first supporting part 54 is formed in a body with the first connecting part 51. The first supporting part 54 has a plate shaped configuration.

Here, a plane surface situated in parallel with a surface 58A of the adhering part 58 at a side facing the first relay board 30 (a surface in the XY plane) is defined as a plane surface B. The first supporting part 54 is formed so that an angle $\theta_1$ formed by the plane surface B and a surface 54A at the side facing the first relay board 30 is an acute angle. The angle $\theta_1$ can be, for example, approximately 5 degrees through approximately 15 degrees.

Thus, since $\theta_1$ is the acute angle, it is possible to prevent the contact of the first relay board 30 or the like and the first supporting part 54 due to the deformation of the spring part 53 when the semiconductor package 100 or the like presses the contact part 52*a*. Hence, it is possible to prevent the damage of the connecting terminal 43, the first relay board 30, and others. The width and thickness of the first supporting part 54 can be the same as, for example, those of the second connecting part 52.

The second supporting part 55 is provided between the spring part 53 and the second connecting part 52. One of end parts of the second supporting part 55 is formed in a body with another end part of the spring part 53. Another end part of the second supporting part 55 is formed in a body with the projecting part 52*b* of the second connecting part 52. The second supporting part 55 has a plate shaped configuration. The width and thickness of the second supporting part 55 can be the same as, for example, those of the second connecting part 52.

The third supporting part 56 is provided so as to support the bending part 57, and the adhering part 58. One of end parts of the third supporting part 56 is formed in a body with the first connecting part 51. Another end part of the third supporting part 56 is formed in a body with the bending part 57. The third supporting part 56 has a plate-shaped configuration. The third supporting part 56 extends in a direction from the first connecting part 51 toward the second connecting part 52 (a direction separating from the first connecting part 51). The width and thickness of the third supporting part 56 can be the same as, for example, those of the second connecting part 52.

The bending part 57 is provided so as to form a designated angle between the third supporting part 56 and the adhering part 58. The bending part 57 has an R-shaped configuration. One of end parts of the bending part 57 is formed in a body with the third connecting part 56. Another end part of the bending part 57 is formed in a body with the adhering part 58. The width and thickness of the bending part 57 can be the same as, for example, those of the second connecting part 52.

The adhering part 58 is provided so that the connecting terminal 43 is adhered to the second relay board 40. The adhering part 58 has a plate-shaped configuration. One of end parts of the adhering part 58 is formed in a body with the bending part 57. The surface 58A of the adhering part 58 is adhered to one of the surfaces of the second relay board 40. The thickness of the adhering part 58 can be substantially equal to, for example, the thickness of the second connecting part 52. It is preferable that the width of the adhering part 58 be greater (in a Y direction) than that of other parts of the adhering part 58 in order to secure the strength for adhering with the second relay board 40.

The connecting terminal 43 is made by, for example, the following steps. First, a metal plate such as a Cu alloy is stamped so as to have a designated configuration. Then, a Ni plating film (having a thickness of, for example, approximately 1 μm through approximately 3 μm) is formed on an entire surface of the stamped metal plate. Next, an Au plating film (having a thickness of, for example, approximately 0.3 μm through approximately 0.5 μm) is formed (an Au plating film is partially formed) on the Ni plating film formed on a portion corresponding to the first connecting part 51 and the contact part 52*a*. After that, a bending process is applied to the metal plate where the Ni plating film and the Au plating film are formed and the stamping process is applied, so that the connecting terminal 43 is manufactured. As a Cu alloy which is a material of the metal plate, for example, phosphor copper, beryllium copper, or the like is used.

The connecting terminal main body (not illustrated) may be formed by etching the metal plate (not illustrated) such as the Cu alloy to a designated configuration and then bending the etched metal plate. A height $H_1$ of the connecting terminal 43 in a state shown in FIG. 6A (a state where the second connecting part 52 of the connecting terminal 43 is not pressed) can be, for example, approximately 1.5 mm. A height $H_2$ of the connecting terminal 43 (a height from the plane surface B to the surface 58A of the adhering part 58) can be, for example, approximately 0.6 mm. A movable range of the connecting terminal 43 can be, for example, approximately 0.4 mm.

Next, a connecting method of the semiconductor package 100 and the mounting board 110 by using the socket 10 is discussed with reference to FIG. 7 through FIG. 12.

Figure 7:
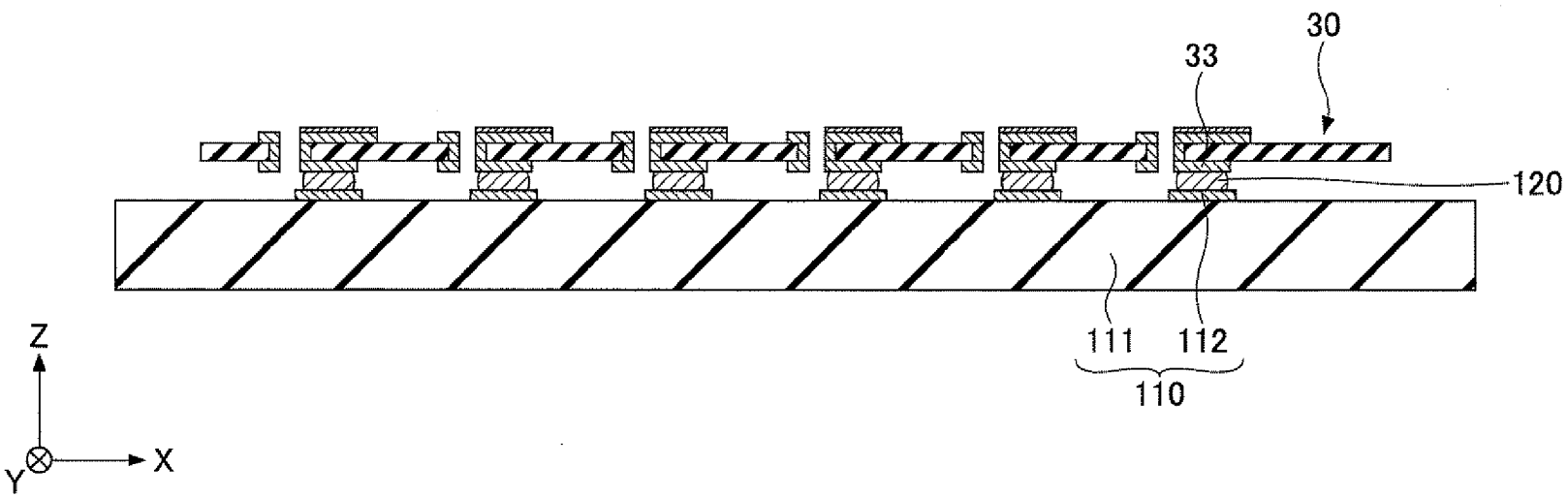
FIG. 7 is a first view showing an example of a connecting method using the socket of the first embodiment of the present invention.

First, as shown in FIG. 7, the mounting board 110 and the first relay board 30 are provided. Then, the mounting board 110 and the first relay board 30 are electrically connected to each other via the solder 120. More specifically, solder pastes are applied to the conductive layer 112 of the mounting board 110 and the conductive layer 33 of the first relay board 30. Then, the conductive layer 112 and the conductive layer 33 are placed to face each other, so that the solder pastes formed on the conductive layer 112 and the conductive layer 33 are made to come in contact with each other. The solder paste is heated at, for example, approximately 230° C. so as to be melted, and thereby the solder 120 is formed.

Figure 8:
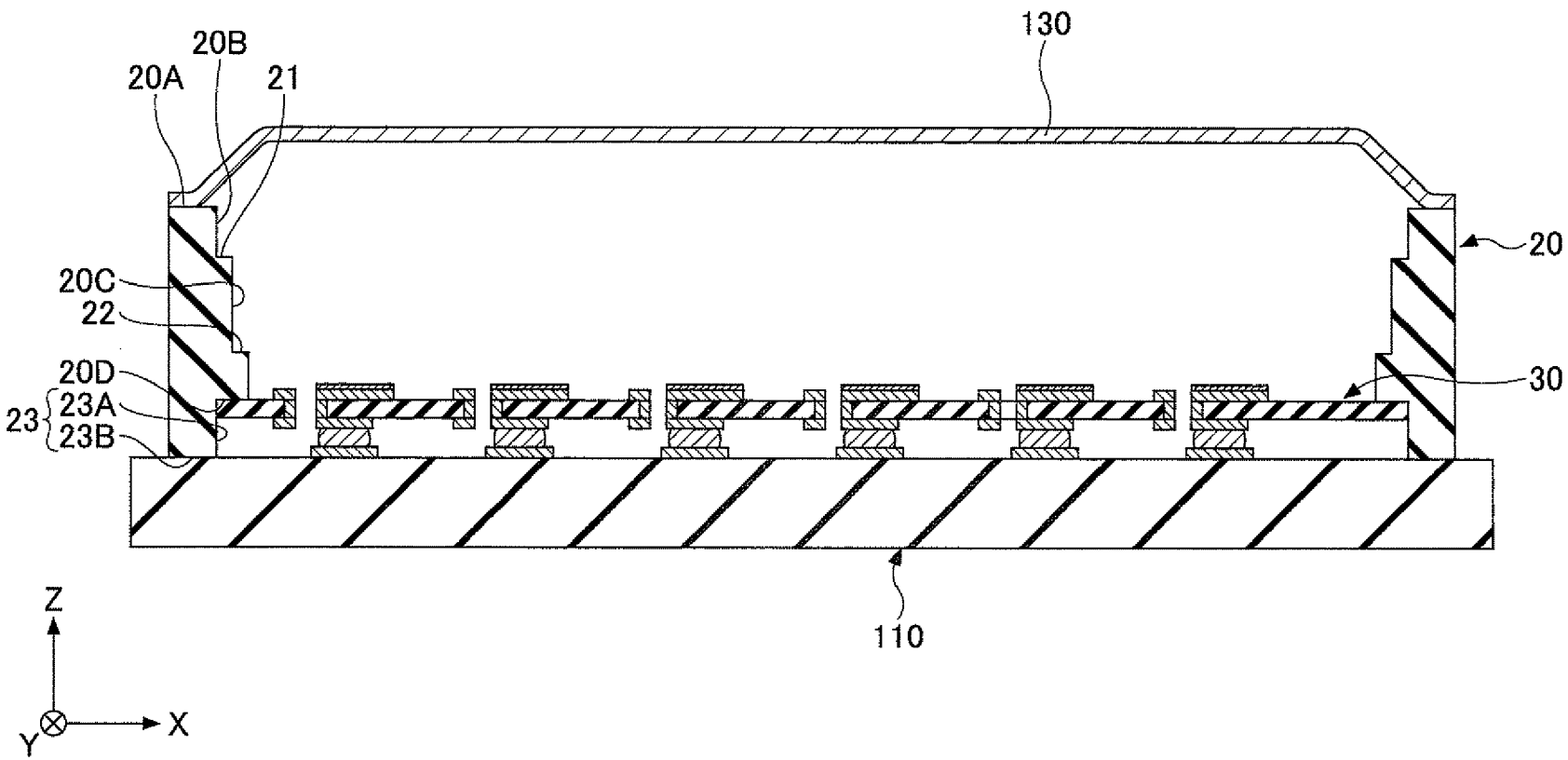
FIG. 8 is a second view showing the example of the connecting method using the socket of the first embodiment of the present invention.

Next, as shown in FIG. 8, the frame part 20 is provided. The frame part 20 is pushed onto the mounting board 110 side so as to surround the first relay board 30. Plural third positioning and holding parts 23 of the frame part 20 are press-fitted to the first relay board 30. As a result of this, the lower surface 20D of the frame part 20 comes in contact with and is fixed to the external edge part of the upper surface of the first relay board 30, and the internal side surfaces 23A of the third positioning and holding parts 23 come in contact with and are fixed to the side surface of the first relay board 30. At this time, since the bottom surface 23B of each of the third positioning and holding parts 23 comes in contact with the upper surface of the mounting board 110, the third positioning and holding parts 23 work as a stopper. Therefore, it is possible to prevent the frame part 20 from being pushed too much to the mounting board 110 side and to prevent the solder 120 or the like from being damaged. The frame part 20 can be manufactured by a transfer mold method using resin or press working, cutting working or the like using metal.

The order of the step shown in FIG. 7 and the step shown in FIG. 8 may be switched. That is, after plural third positioning and holding parts 23 of the frame part 20 are press-fitted to the first relay board 30, a reflow process may be applied to the first relay board 30 together with the frame part 20 so that the first relay board 30 with the frame part 20 is electrically connected to the mounting board 110 via the solder 120.

Figure 9:
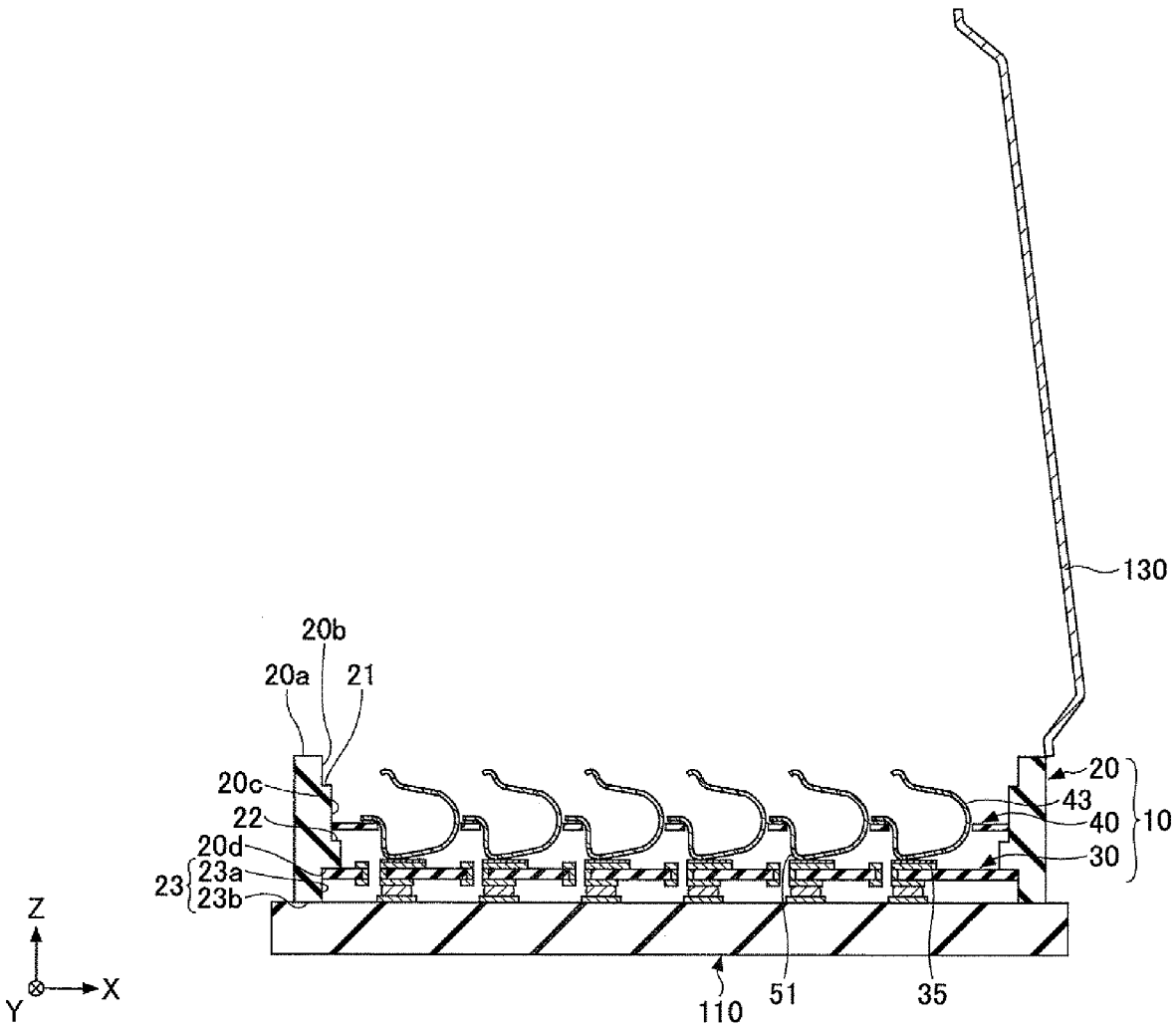
FIG. 9 is a third view showing the example of the connecting method using the socket of the first embodiment of the present invention.
Figure 10:
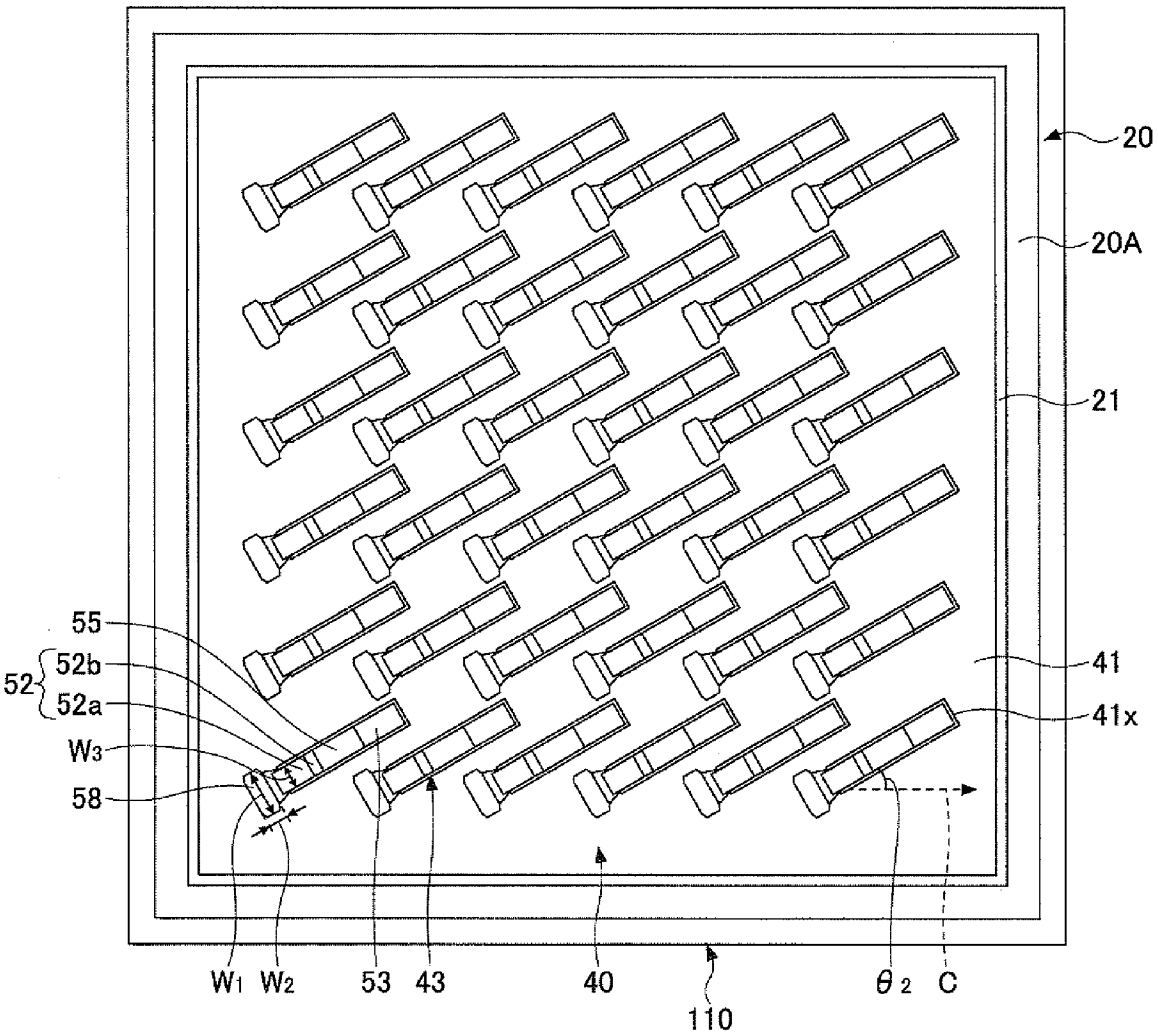
FIG. 10 is a fourth view showing the example of the connecting method using the socket of the first embodiment of the present invention.

Next, as shown in FIG. 9 (cross-sectional view) and FIG. 10 (plan view), the second relay board 40 is provided. The lid part 130 is rotated so that the second relay board 40 can be arranged. The second relay board 40 is provided so that an external edge part of a lower surface of the second relay board 40 faces the second positioning and holding parts 22 and the side surface of the second relay board 40 is supported by the internal side surface 20*c*. At this point, since the connecting terminal 43 is not pressed, the external edge part of the lower surface of the second relay board 40 does not come in contact with the second positioning and holding part 22. Positioning of the first relay board 30 and the second relay board 40 is made by the frame part 20. The connecting terminals 43 come in contact with the corresponding pads of the noble metal layer 35 of the first relay board 30.

In the second relay board 40 of the first embodiment, plural connecting terminals 43 are arranged so that designated angles $\theta_2$ relative to an arrangement direction C of the connecting terminal 43 (see FIG. 10) are formed. In other words, plural connecting terminals 43 are obliquely arranged relative to the arrangement direction C of the connecting terminal 43. The designated angle $\theta_2$ can be, for example, approximately 25 degrees through approximately 35 degrees. Widths $W_1$ and $W_2$ of the adhering part 58 can be, for example, approximately 0.4 mm. The width $W_3$ of the second connecting part 52 can be, for example, approximately 0.2 mm.

Thus, in this case where plural connecting terminals 43 are arranged obliquely relative to the arrangement direction C of the connecting terminals 43, compared to a case where plural connecting terminals 43 are arranged in parallel with the arrangement direction C, it is possible to arrange a large number of the connecting terminals 43 per unit area. Because of this, the pads of the noble metal layers 35 and 105 coming in contact with the connecting terminals 43 can be provided with narrow pitches. The pitches of the pads of the noble metal layers 35 and 105 can be, for example, approximately 0.8 mm through approximately 1.0 mm. The arrangement of plural connecting terminals 43 is not limited to the example shown in FIG. 10. The connecting terminals 43 may be arranged in parallel with the arrangement direction C.

The second relay board 40 can be manufactured by, for example, the following method. That is, the through holes 41*x* are formed in the board main body 41 by press work or the like. The adhesive 42 made of, for example, the thermosetting epoxy group is applied in positions of one of the surfaces of the board main body 41 corresponding to the adhering parts 58 of the connecting terminals 43. The connecting terminal 43 is inserted into the through hole 41*x*. By inserting the connecting terminal 43 into the through hole 41*x*, the second connecting part 52, the second supporting part 55, and a part (at a side connected to the second supporting part 55) of the spring part 53 project to one of the surfaces of the board main body 41. In addition, the third supporting part 56, the first connecting part 51, the first supporting part 54, and a part (at a side connected to the first supporting part 54) of the spring part 53 project to another surface of the board main body 41.

When the connecting terminals 43 are inserted into the through hole 41*x*, positioning is done by a designated jig so that the connecting terminals 43 project from both the surfaces of the board main body 41 with designated amounts. In addition, the adhesive 42 is heated at a temperature equal to or higher than a curing temperature so as to be cured. Thus, the second relay board 40, where the connecting terminals 43 are inserted into the through holes 41*x* and are adhered to one of the surfaces of the board main body 41 by the adhesive 42 so as to project from both the surfaces of the board main body 41, is manufactured.

Figure 11:
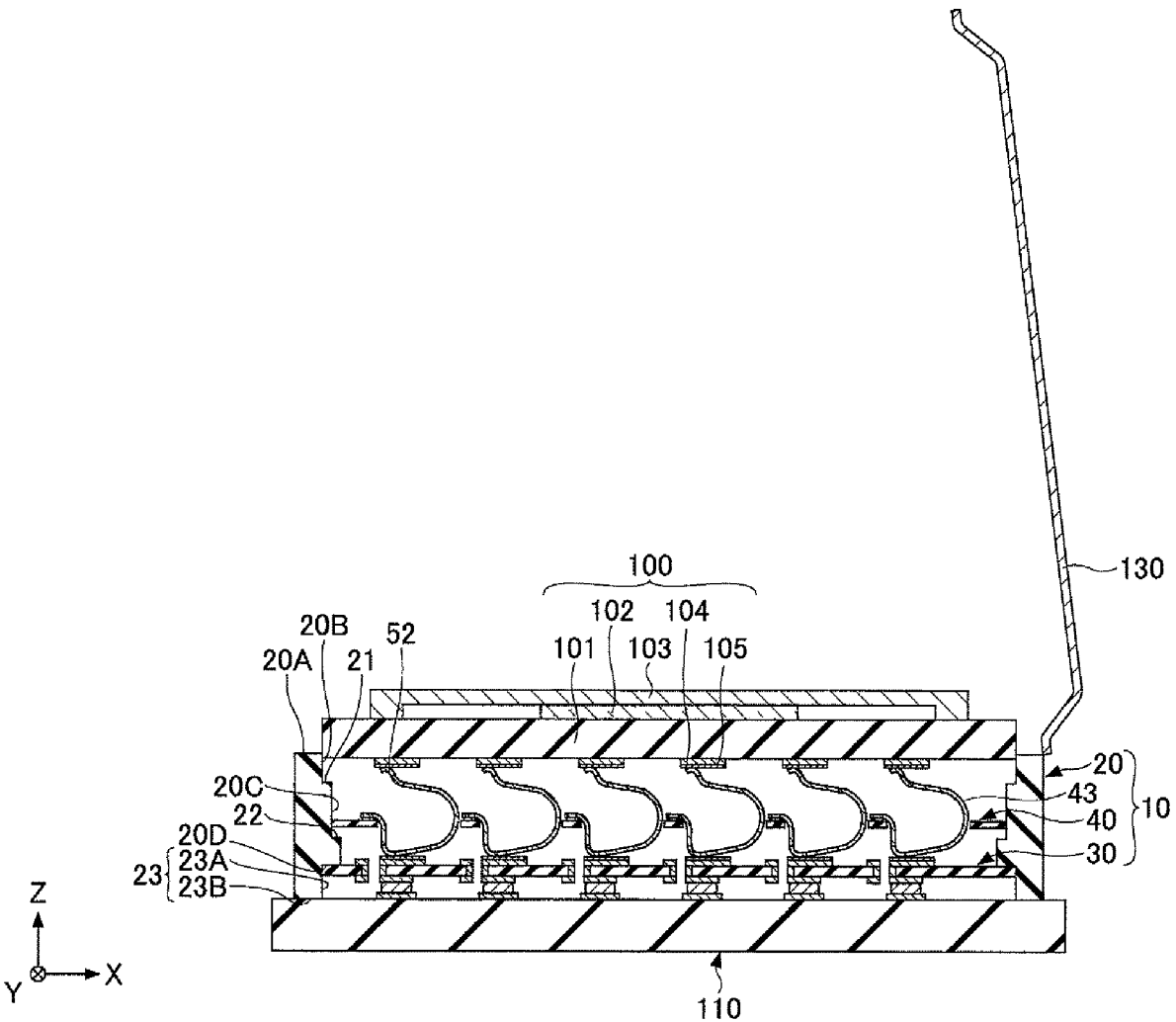
FIG. 11 is a fifth view showing the example of the connecting method using the socket of the first embodiment of the present invention.

Next, as shown in FIG. 11, the semiconductor package 100 is provided. An external edge part of the lower surface of the board 101 of the semiconductor package 101 faces the first positioning and holding part 21. A side surface of the board 101 is supported by the internal side surface 20B. At this time, since the connecting terminal 43 is not pressed, the external edge part of the lower surface of the board 101 does not come in contact with the first positioning and holding part 21.

Positioning of the semiconductor package 100 and the second relay board 40 is made by the frame part 20. The connecting parts 52 of the connecting terminals 43 come in contact with the corresponding pads of the noble metal layer 105 of the semiconductor package 100.

Figure 12:
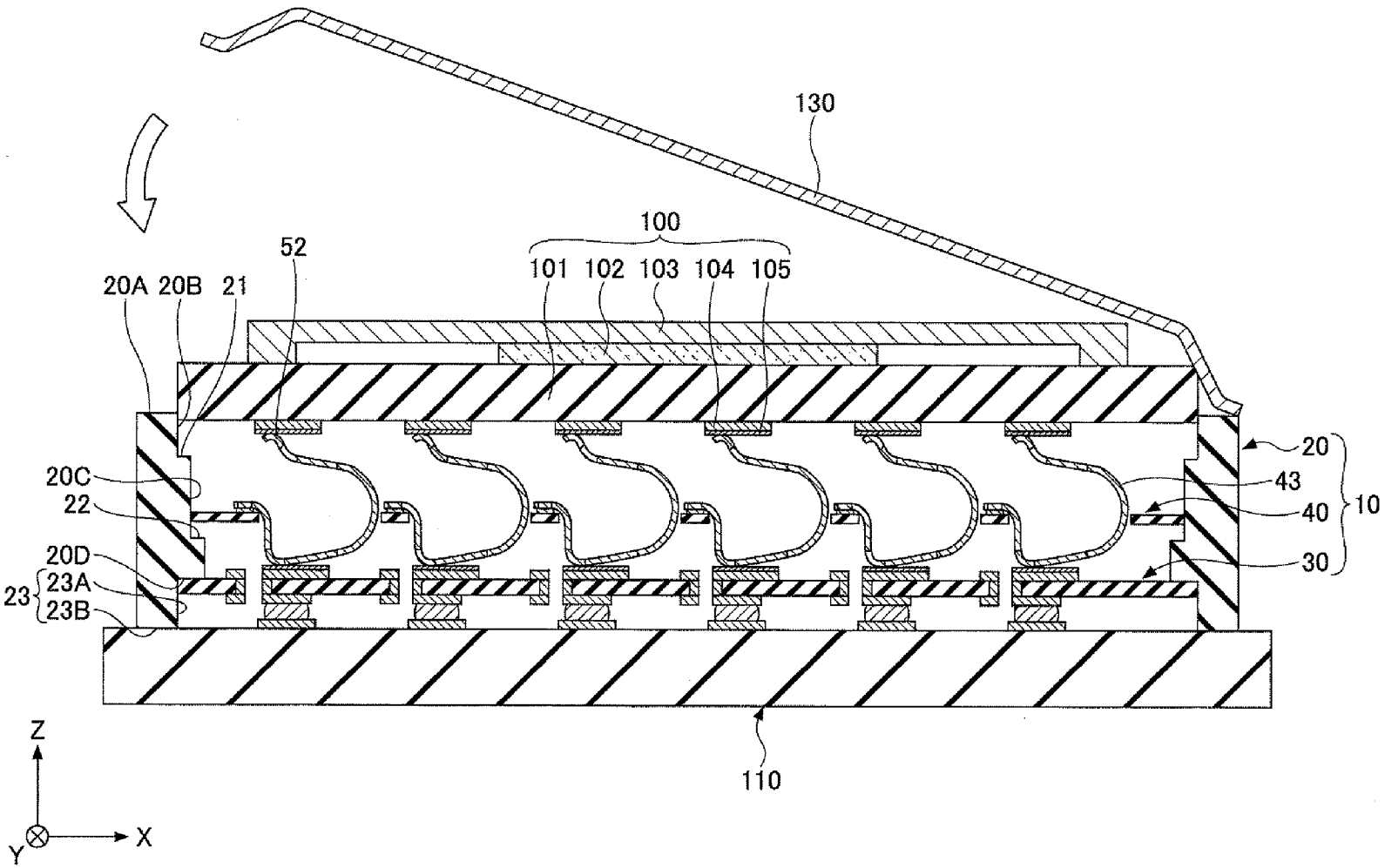
FIG. 12 is a sixth view showing the example of the connecting method using the socket of the first embodiment of the present invention.

Next, as shown in FIG. 12, the lid part 130 is rotated in a direction indicated by an arrow, so that the semiconductor package 100 is pushed to the mounting board 110 side and the external edge part of the lid part 130 comes in contact with and is fixed (locked) to the upper surface 20A of the frame part 20. As a result of this, the connecting terminals 43 are pressed and deformed in the Z direction, so that a designated spring force is generated. As a result of this, the semiconductor package 100 is securely and electrically connected to the first relay board 30 via the connecting terminals 43 of the second relay board 40 (see FIG. 3). In other words, the semiconductor package 100 is electrically connected to the mounting board 110 via the socket 10.

Since the semiconductor package 100 is held by the first positioning and holding part 21, the semiconductor package 100 is not pushed to the mounting board 100 side farther than the first positioning and holding part 21. Thus, the first positioning and holding part 21 works as a stopper which prevents the connecting terminals 43 from being deformed more than necessary and from being damaged due to the semiconductor package 100 being pushed more than necessary. In addition, since the second relay board 40 is held by the second positioning and holding part 22, the second relay board 40 is not pushed to the mounting board 100 side farther than the second positioning and holding part 22. Thus, the second positioning and holding part 22 works as a stopper which prevents the connecting terminal 43 from being deformed more than necessary and from being damaged due to the second relay board 40 being pushed more than necessary.

As discussed above, according to the first embodiment of the present invention, in the socket 10 configured to electrically connect the electronic device such as the semiconductor package 100 and the mounting board 110 or the like, the socket including the frame part, the first relay board, and the second relay board, a housing which fixes the connecting terminal having the spring effect and which causes the warpage is not provided at the board main body of the second relay board. Therefore, the socket where the warpage may not be easily generated can be realized. By preventing generation of the warpage, it is possible to improve the reliability for connecting the semiconductor package and the mounting board to each other.

In addition, the second relay board is not fixed to the neighboring first relay board and the semiconductor package by the solder or the like.

The second relay board can be attached to or detached from the frame part. Therefore, even if the connecting terminal is damaged, it is possible to replace the second relay board with a good one.

Furthermore, in the second relay board, unlike the related art relay board (shown in FIG. 2), the connecting terminal is not fixed to both surfaces. A single connecting terminal is inserted through a through hole and fixed so as to project from both surfaces. Accordingly, it is possible to shorten the length between one end and another end of the connecting terminal. Because of this, it is possible to shorten a connecting length between the semiconductor package as an electronic device and the mounting board such as the motherboard (transmission path of the signal), so that electric properties can be improved. In addition, with this structure, it is possible to make the height of the socket low.

Furthermore, the first relay board is connected to the mounting board such as the motherboard and the connecting terminals having a spring effect come in contact with the noble metal layer of the first relay board. Therefore, it is possible to achieve the high connecting reliability. (If the first relay board is not provided and the connecting terminal having the spring effect is made to directly come in contact with a conductive layer (pads) having a surface of the mounting board such as the motherboard, the surface being where the noble metal layer is not provided, sufficient connecting reliability cannot be achieved.)

In addition, since the first relay board is made of the same material as that of the mounting board such as the motherboard, the first relay board and the mounting board such as the motherboard have the substantially same coefficients of thermal expansion. Therefore, even if the mounting board such as the motherboard becomes curved, the first relay board is curved in the same direction. Hence, it is possible to improve the connecting reliability between the first relay board and the mounting board such as the motherboard. In addition, even if the first relay board becomes curved, as long as the second relay board is rigid, the connecting terminals having the spring effect cancel the warpage of the first relay board. If the second relay board is flexible, the second relay board can follow the warpage of the first relay board. Hence, it is possible to keep the connecting reliability between the first relay board and the second relay board.

(Modified Example 1 of the First Embodiment)

In a modified example 1 of the first embodiment, a frame part 60, instead of the frame part 20, is used. Since a cross-sectional view of a socket of the modified example 1 of the first embodiment is the same as FIG. 3 and FIG. 4, illustration thereof is omitted. In the following, explanation of parts that are the same as the parts discussed in the first embodiment is omitted and the frame part 60 is mainly discussed.

Figure 13A:
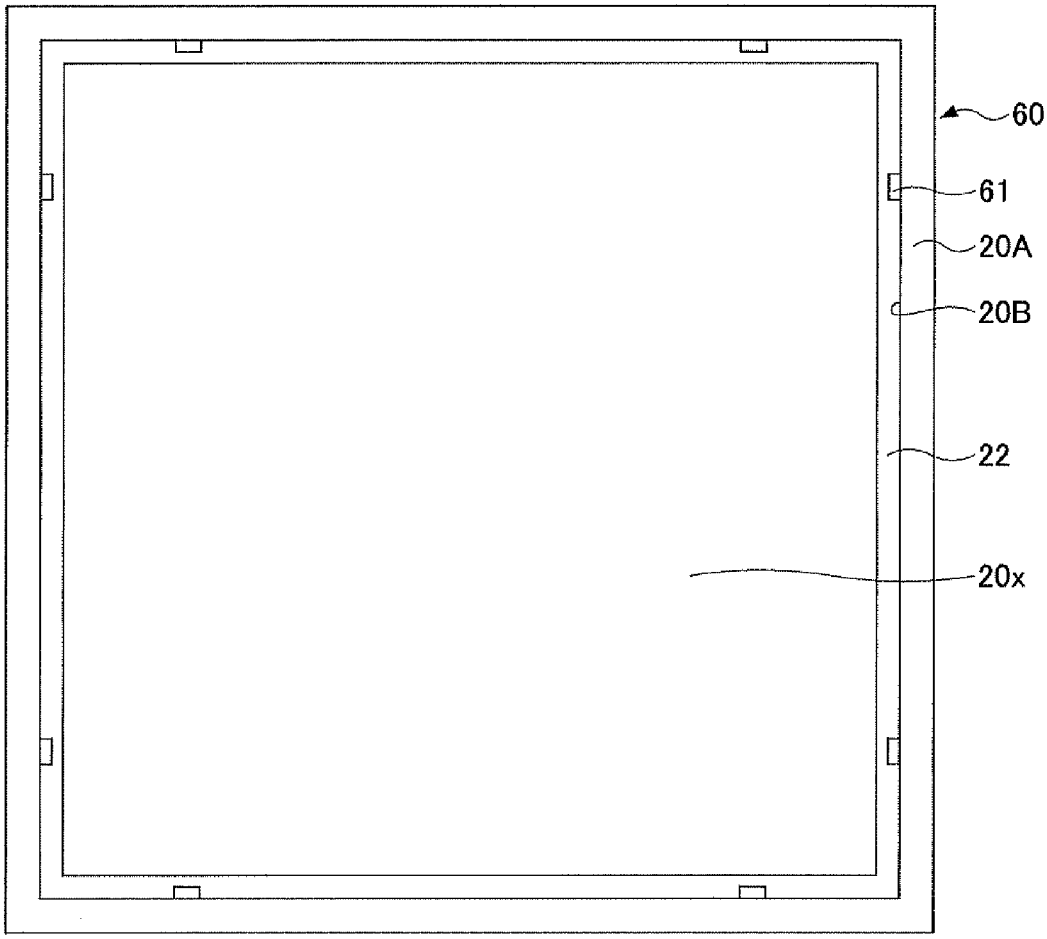
FIG. 13A is a plan view showing an example of a frame part of a socket of a modified example 1 of the first embodiment of the present invention.
Figure 13B:
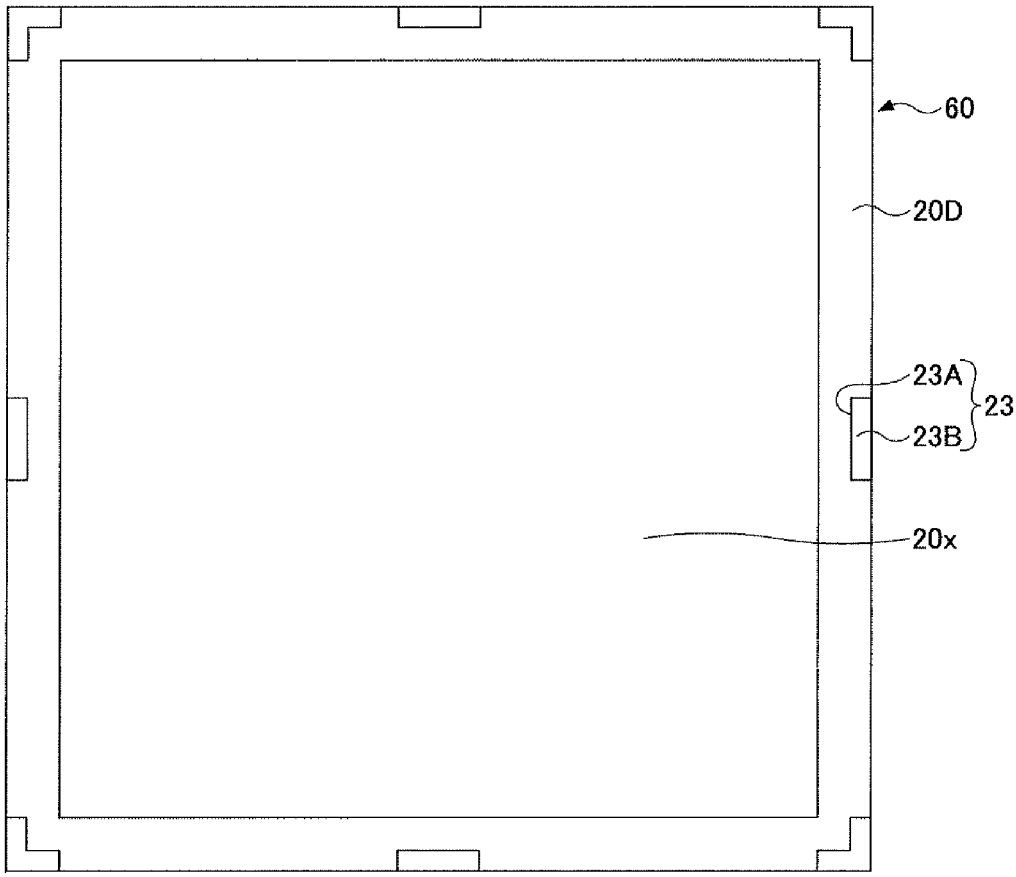
FIG. 13B is a bottom view showing the example of the frame part of the socket of the modified example 1 of the first embodiment of the present invention.
Figure 13C:
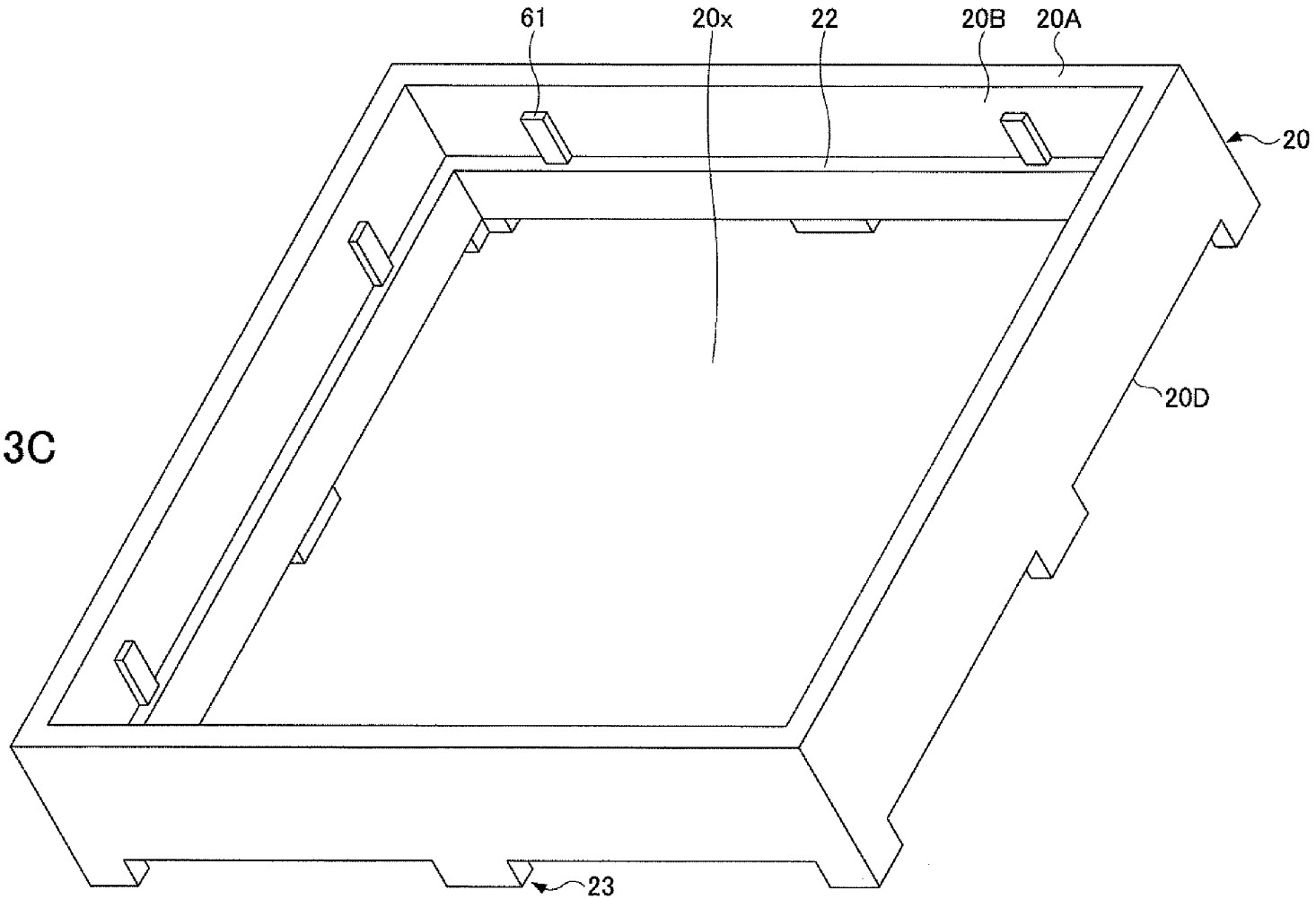
FIG. 13C is a perspective view showing the example of the frame part of the socket of the modified example 1 of the first embodiment of the present invention.

FIG. 13A through FIG. 13C are views showing an example of the frame part 60 of the socket of the modified example 1 of the first embodiment of the present invention. FIG. 13A is a plan view, FIG. 13B is a bottom view, and FIG. 13C is a perspective view. Referring to FIG. 13A through FIG. 13C, the frame part 60 has the same structure as that of the frame 20 except that a first positioning and holding part 61, instead of the first positioning and holding part 21, is provided.

In the first embodiment, the first positioning and holding part 21 is a surface provided in the frame-shaped manner in the position one step below and inside the upper surface 20A of the frame part 20. On the other hand, in the modified example 1 of the first embodiment, the first positioning and holding parts 61 provide a partial surface in the position one step below and inside an upper surface 20A of the frame part 60.

The first positioning and holding parts 61 come in contact with an external edge part of a lower surface of the board 101 of the semiconductor package 100. An opening part forming an internal side surface 20B has a rectangular shaped configuration corresponding to a planar shaped configuration of the semiconductor package 100. In addition, the configuration of the opening part forming the internal side surface 20B is slightly larger than an external configuration of the board 101 so that the semiconductor package 100 can be attached or detached. The internal side surface 20B and a side surface of the board 101 may come in contact with each other. A gap may be provided between the internal side surface 20B and a side surface of the board 101 as long as a positional shift is not generated between the second relay board 40 and the semiconductor package 100.

Figure 14:
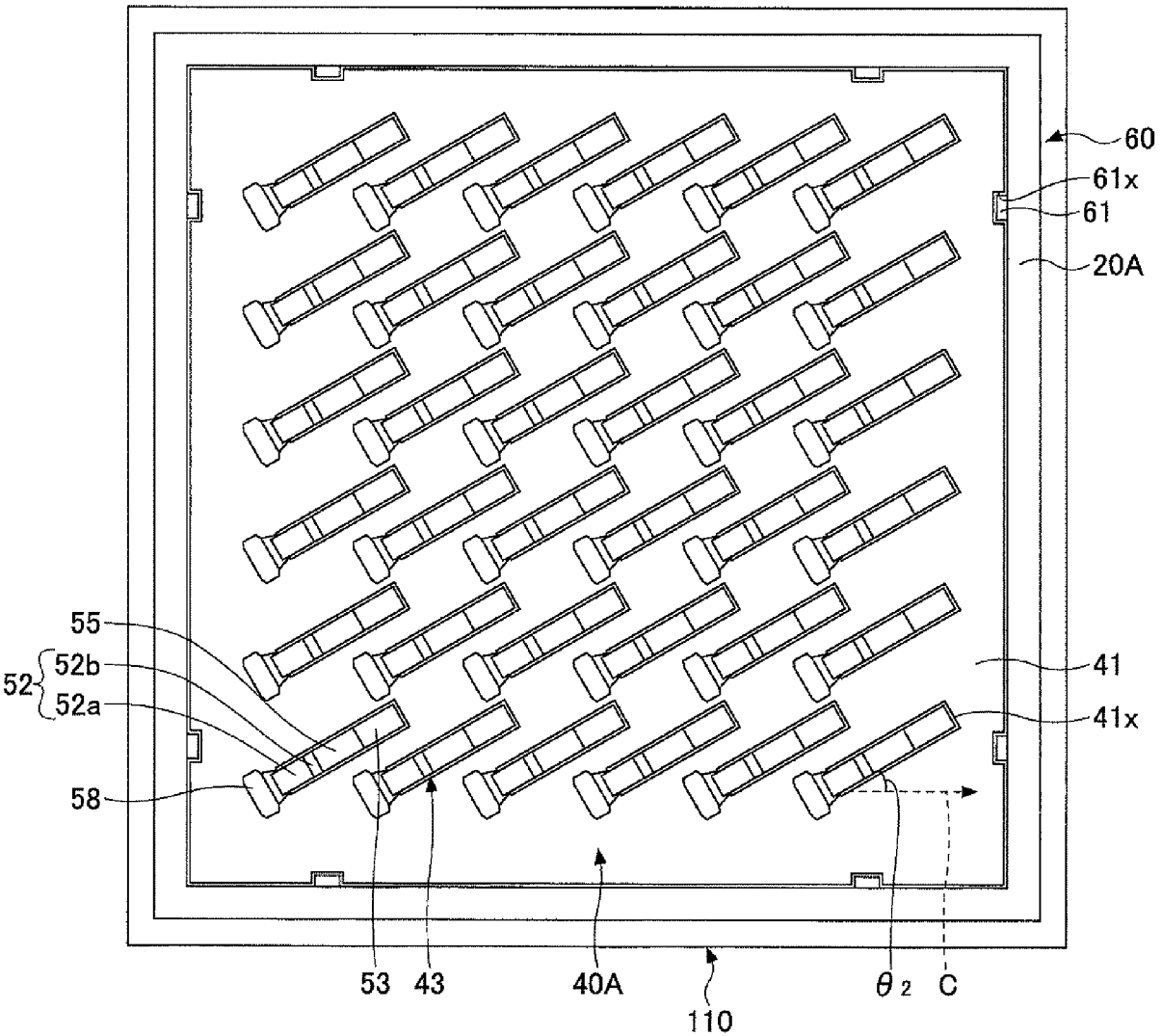
FIG. 14 is a plan view of an example of a second relay board of the modified example 1 of the first embodiment of the present invention.

The external configuration of the second relay board 40 in the modified example 1 may be the same as that in the first embodiment. Alternatively, a second relay board 40A where a notch part 61*x* having a configuration corresponding to the configuration of the first positioning and holding part 61 is provided at the external edge part, as shown in FIG. 14, may be used. Because of the configuration of the second relay board 40A, a maximum external configuration of the second relay board 40A can be larger than that of the second relay board 40. The connecting terminals 43 can be provided close to the external edge part. With this structure, it is possible to correspond to a case where the pads of the conductive layer 104 and the noble metal layer 105 of the semiconductor package 100 are provided close to the external edge part of the board 101.

Thus, according to the modified example 1 of the first embodiment, it is possible to achieve not only the same effect as that of the first embodiment but also the following effect. That is, it is possible to connect to the semiconductor package where the pads (the conductive layer 104 and the noble metal layer 105) are provided close to the external edge part of the board.

(Modified Example 2 of the First Embodiment)

In the modified example 2 of the first embodiment, an example where the connecting terminal is fixed to the board main body of the second relay board by a method different from that in the first embodiment is discussed. In the following explanation, explanation of parts that are the same as the parts discussed in the first embodiment is omitted and a second relay board 70 is mainly discussed.

Figure 15:
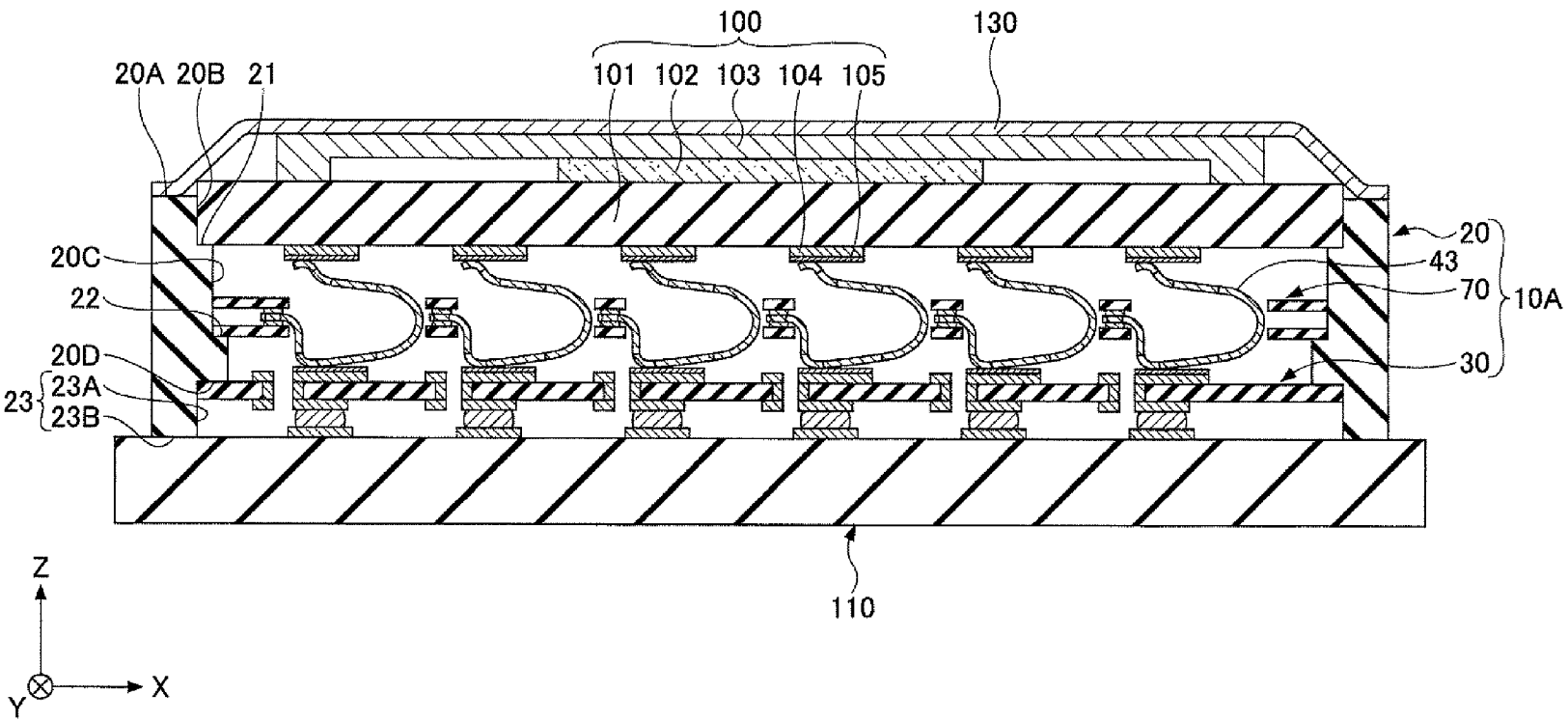
FIG. 15 is a cross-sectional view of an example of a socket of a modified example 2 of the first embodiment of the present invention.
Figure 16:
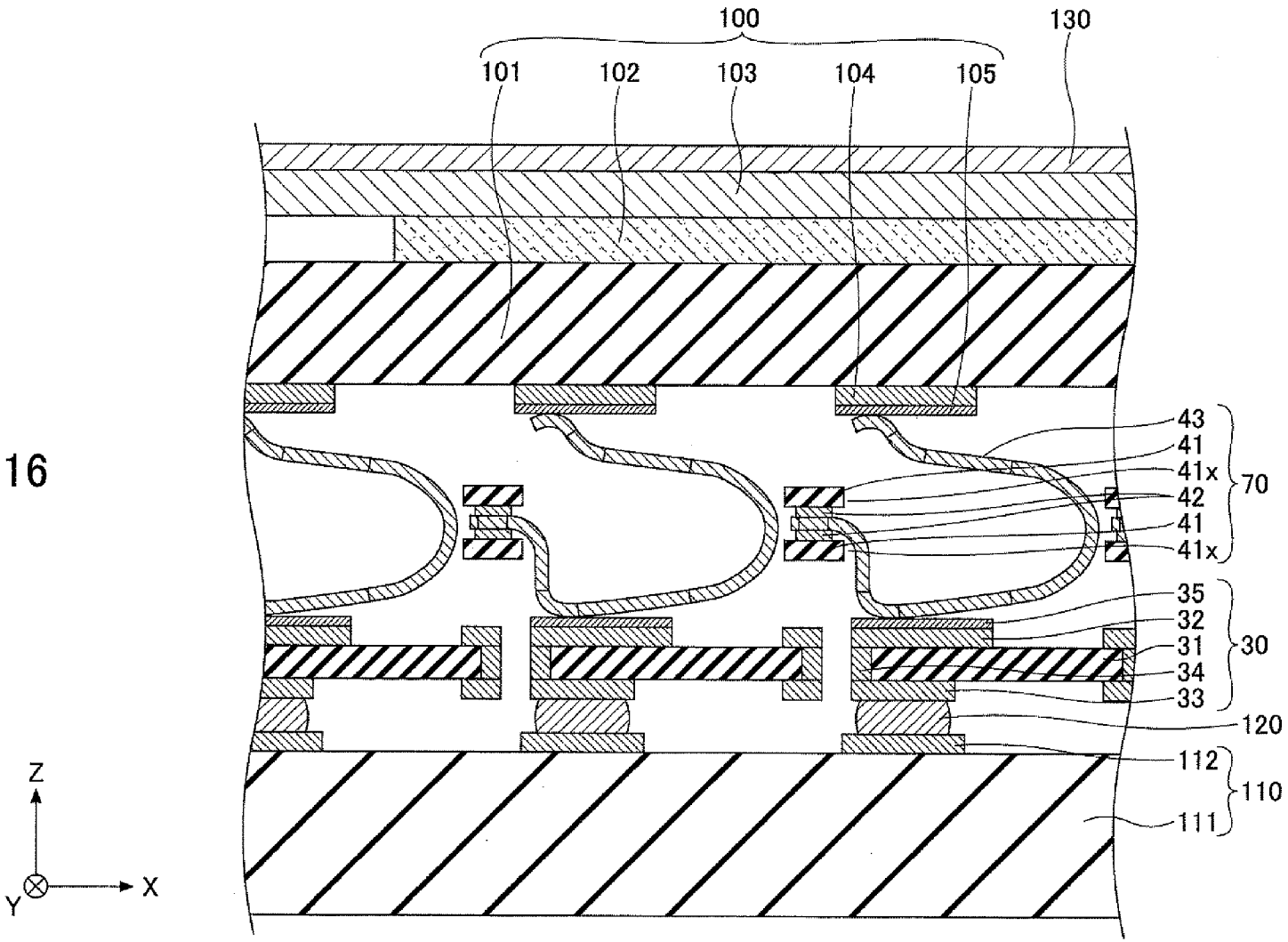
FIG. 16 is a cross-sectional view where a part of a structure shown in FIG. 15 is shown in an expanded manner.

FIG. 15 is a cross-sectional view of an example of a socket of a modified example 2 of the first embodiment of the present invention. FIG. 16 is a cross-sectional view where a part of a structure shown in FIG. 15 is shown in an expanded manner. Referring to FIG. 15 and FIG. 16, a socket 10A is different from the socket 10 (see FIG. 3 and FIG. 4) in that the second relay board 40 is replaced with the second relay board 70.

In the second relay board 70, the connecting terminal 43 is inserted through the through hole 41*x* of the board main body 41 at the first relay board 30 side and is adhered to one of the surfaces of the board main body 41 so as to project from both surfaces of the board main body 41. In addition, the connecting terminal 43 is inserted through the through hole 41*x* of the board main body 41 at the semiconductor package 100 side and is adhered to one of the surfaces of the board main body 41 so as to project from both surfaces of the board main body 41. In other words, both surfaces of the adhering part 58 are sandwiched and fixed by the two board main bodies 41 via the adhesives 42 so that the connecting terminal 43 projects from between the two board main bodies 41.

Thus, according to the modified example 2 of the first embodiment, it is possible to achieve not only the same effect as that of the first embodiment but also the following effect. That is, it is possible to improve the adhesion strength of the connecting terminal relative to the board main body by sandwiching and fixing the connecting terminal with two of the board main bodies.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that the various changes, substitutions, and alterations could be made hereto without departing from the spirit and scope of the invention.

In the above-discussed embodiment and modified examples, examples where the socket of the present invention is applied to the mounting board such as the motherboard are explained. However, the socket of the present invention can be applied to a semiconductor package test board or the like. For example, by applying the socket of the present invention to the semiconductor package test board, it is possible to repeat the test of the electric properties of the semiconductor package.

What is claimed is:

1. A socket, comprising:

a first relay board provided above a mounting board;

a second relay board detachably provided above the first relay board; and a frame part provided at side parts of the first relay board and the second relay board, wherein the frame part is configured to hold the first relay board and the second relay board and detachably configured to hold an electronic device being mounted above the second relay board;

the second relay board includes a board main body having a through hole, and a connecting terminal fixed to the board main body in a state where the connecting terminal is inserted through the through hole, the connecting terminal including a first connecting part configured to project from the board main body to the first relay board side and a second connecting part configured to project from the board main body to the electronic device side, and the first connecting part comes in contact with the first relay board and the second connecting part comes in contact with a pad of the electronic device, so that the electronic device and the mounting board are electrically connected to each other.

2. The socket as claimed in claim 1, wherein the first relay board includes a first conductive layer formed on a surface situated at a side opposite to a surface facing to the mounting board, and a second conductive layer formed on the surface facing to the mounting board.

3. The socket as claimed in claim 1, wherein external edge parts of the first relay board and the second relay board come in contact with an internal side surface of the frame part and are held by the frame part.

4. The socket as claimed in claim 1, wherein, in a case where the electronic device is pressed to the mounting board side in a state where the electronic device is mounted on the second relay board by the frame part, the first connecting part comes in contact with the first conductive layer of the first relay board and the second connecting part comes in contact with a pad of the electronic device, so that the electronic device and the mounting board are electrically connected to each other.

5. The socket as claimed in claim 1, wherein the frame part positions and holds the first relay board, the second relay board, and the electronic device, so that a gap between the first relay board and the second relay board and a gap between the second relay board and the electronic device are prevented from being equal to or less than a designated value.

6. The socket as claimed in claim 1, wherein, in the connecting terminal, the first connecting part and the second connecting part are provided so as to face each other, and a part having a curved configuration is included between the first connecting part and the second connecting part.

7. The socket as claimed in claim 1, wherein the electronic device includes a large number of the pads, the pads being arranged in a grid manner on a surface facing the second relay board; and plural of the connecting terminals are arranged corresponding to the large number of the pads.

8. The socket as claimed in claim 7, wherein the connected terminals are arranged obliquely, in a planar view, relative to the pads arranged in the grid manner.

9. The socket as claimed in claim 1, wherein a main ingredient of a material of the mounting board has a coefficient of thermal expansion equal to a coefficient of thermal expansion of a main ingredient of a material of the first relay board.

10. The socket as claimed in claim 1, wherein a plurality of projecting parts is provided at an internal side surface of the frame part;

a plurality of notch parts is provided at an external edge part of the second relay board; and the plural notch parts are engaged with the plural projecting parts, respectively, so that the second relay board is positioned.

11. The socket as claimed in claim 1, wherein a noble metal layer is stacked on the first conductive layer; and in a case where the electronic device is pressed to the mounting board side in a state where the electronic device is mounted on the second relay board by the frame part, the first connecting part of the connecting terminal of the second relay board comes in contact with the noble metal layer of the first relay board and the second connecting part of the connecting terminal of the second relay board comes in contact with the pad of the electronic device, so that the electronic device and the mounting board are electrically connected to each other.

12. The socket as claimed in claim 2, wherein a noble metal layer is formed on each of a surface of the first conductive layer and a surface of the second conductive layer.

13. The socket as claimed in claim 1, wherein the second relay board includes two board main bodies having through holes;

the connecting terminal includes an adhering part extending from the first connecting part toward the second connecting part side; and the connecting terminal is inserted through the through holes of the two board main bodies so that the adhering part is sandwiched and fixed by the two board main bodies via an adhesive.

* * * * *